US009981466B2

(12) United States Patent
Abe

(10) Patent No.: US 9,981,466 B2
(45) Date of Patent: May 29, 2018

(54) LIQUID EJECTING APPARATUS AND DRIVE CIRCUIT

(71) Applicant: SEIKO EPSON CORPORATION, Tokyo (JP)

(72) Inventor: Akira Abe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/650,014

(22) Filed: Jul. 14, 2017

(65) Prior Publication Data

US 2018/0037024 A1 Feb. 8, 2018

(30) Foreign Application Priority Data

Aug. 8, 2016 (JP) ..... 2016-155579

(51) Int. Cl.
*B41J 2/045* (2006.01)

(52) U.S. Cl.
CPC ..... *B41J 2/0455* (2013.01); *B41J 2/0457* (2013.01); *B41J 2/04518* (2013.01); *B41J 2/04523* (2013.01); *B41J 2/04541* (2013.01); *B41J 2/04548* (2013.01); *B41J 2/04581* (2013.01)

(58) Field of Classification Search
CPC .. B41J 2/0455; B41J 2/04523; B41J 2/04518; B41J 2/04548; B41J 2/04541; B41J 2/04581; B41J 2/0457; H03K 3/013; H03K 4/835
See application file for complete search history.

(56) References Cited

U.S. PATENT DOCUMENTS 7,852,128 B2 12/2010 Kitazawa et al.
2015/0062214 A1* 3/2015 Kashimura ..... B41J 2/0459 347/9
2017/0001435 A1* 1/2017 Nozawa ..... B41J 2/04541

FOREIGN PATENT DOCUMENTS

JP 2009-190287 A 8/2009
JP 2010-114711 A 5/2010

* cited by examiner

*Primary Examiner* — Julian Huffman

(57) ABSTRACT

A drive circuit includes an amplification unit that amplifies a signal and outputs the amplified signal toward a node; and a voltage output unit that outputs a voltage responding to the signal toward the node during a predetermined period of a part or all of a period in which a magnitude of a voltage change of the signal is less than or equal to a threshold. The amplification unit includes a differential amplifier, a selector, and transistors, and the voltage output unit includes a linear amplifier and a switch.

9 Claims, 22 Drawing Sheets

<DECODED CONTENT OF DECODER>

| | PRINT DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NO RECORD | (0, 0) | L | H | L | L |

MSB LSB

LIQUID EJECTING APPARATUS AND DRIVE CIRCUIT

CROSS-REFERENCE TO RELATED APPLICATION

The entire disclosure of Japanese Patent Application No. 2016-155579, filed Aug. 8, 2016 is expressly incorporated by reference herein.

BACKGROUND

1. Technical Field

The present invention relates to a liquid ejecting apparatus and a drive circuit.

2. Related Art

An apparatus which uses a piezoelectric element (for example, a piezo element) is known as an ink jet printer which prints an image or a document by ejecting ink. Piezoelectric elements are provided in correspondence with each of multiple nozzles in a head unit and each of the piezoelectric elements is driven in accordance with a drive signal. A predetermined amount of ink (liquid) is ejected by such driving from the nozzle at a predetermined timing, and thereby, dots are formed. The piezoelectric element is a capacitive element such as a capacitor from a viewpoint of electricity, and needs to receive a sufficient current in order to operate the piezoelectric elements of each nozzle.

Accordingly, an ink jet printer has a configuration in which an original drive signal that is an origin of a drive signal is amplified by an amplification circuit, is supplied to a head unit as the drive signal, and drives a piezoelectric element. For example, D-class amplification is proposed as the amplification circuit (refer to JP-A-2010-114711). In short, in the D-class amplification, a pulse modulation of the original drive signal is performed, a high side transistor and a low side transistor serially inserted between the power supply voltages are switched in response to a modulation signal, an output signal generated by the switching is filtered by a low pass filter, and thereby, the original drive signal is amplified.

However, a problem is pointed out in which waveform reproducibility of a drive signal with respect to an original drive signal is bad in the D-class amplification. In detail, in the class D amplification, even in case where, for example, an output voltage has to be kept constant, a high side transistor and a low side transistor are alternately switched, and thereby, a ripple caused by the switching easily ride.

If it is intended to remove the ripple by using the low pass filter, another problem occurs in which a large capacitor and an inductor with a large L value are required as configuration elements of the low pass filter and thereby a device configuration is bulky.

SUMMARY

An advantage of some aspects of the invention is to provide a liquid ejecting apparatus and a drive circuit which have good waveform reproducibility.

According to an aspect of the invention, there is provided a liquid ejecting apparatus including an ejecting unit that includes a piezoelectric element which is driven based on a drive signal that is output from a predetermined output terminal, and ejects liquid by driving the piezoelectric element; an amplification unit that amplifies an original drive signal which is an origin of the drive signal and outputs the amplified signal toward the output terminal; and a voltage output unit that outputs a voltage responding to the original drive signal toward the output terminal during a predetermined period of a part or all of a period in which a magnitude of a voltage change of the original drive signal is less than or equal to a threshold.

According to the liquid ejecting apparatus of the aspect, a low pass filter is not necessary, and thus, it is possible to prevent a device configuration from increasing. In addition, in case where the voltage change of the original drive signal is small, the voltage output unit outputs a voltage responding to the original drive signal toward the output terminal, and thus, ripples are hard to ride, spike noise or the like is also hard to occur, and an error of the drive signal with respect to the original drive signal can also be reduced.

"be output toward" means that "another intermediate element may intervene in the middle of a route to".

In the liquid ejecting apparatus according to the aspect, the voltage output unit may include a linear amplifier that amplifies a voltage of the original drive signal by a predetermined multiple, and a variable resistor that is provided between the linear amplifier and the output terminal and has a resistance value which is set during the predetermined period is smaller than a resistance value which is set during a period other than the predetermined period. The variable resistor may be a switch that is turned on during the predetermined period.

In the liquid ejecting apparatus according to the aspect, the amplification unit may include a differential amplifier that outputs a differential signal which is obtained by amplifying a differential voltage between the original drive signal and a signal based on the drive signal, a high side transistor that is coupled between a high side of the a power supply and the output terminal, a low side transistor that is coupled between the output terminal and a low side of the power supply, and a select unit that supplies the differential signal toward a gate terminal of the high side transistor in a first case where a voltage change of the original drive signal is in an increasing direction and a magnitude of the voltage change exceeds the threshold, and supplies the differential signal toward a gate terminal of the low side transistor in a second case where the voltage change of the original drive signal is in a decreasing direction and the magnitude of the voltage change exceeds the threshold.

Coupling means direct and indirect coupling between two elements or more and includes existence of one intermediate element or more between the two elements or more. In the above examples, a diode for preventing a reverse current may be provided between the high side transistor and the output terminal.

In addition, in a configuration in which a differential amplifier, a high side transistor, a low side transistor, and a selector are included, the select unit may supply a signal which turns off the low side transistor toward the gate terminal of the low side transistor in the first case, may supply a signal which turns off the high side transistor toward the gate terminal of the high side transistor in the second case, and may supply the signal which turns off the high side transistor toward the gate terminal of the high side transistor and supplies the signal which turns off the low side transistor toward the gate terminal of the low side transistor, in case where the magnitude of the voltage change of the original drive signal is less than or equal to the threshold.

Furthermore, the select unit may turn off both the high side transistor and the low side transistor, based on a designation signal that indicates whether or not the voltage change of the original drive signal is less than or equal to the threshold.

In addition, in case where a designation signal is used, the variable resistor may be a switch which is turned on or off in response to the designation signal.

In the liquid ejecting apparatus according to the aspect, the ejecting unit, the amplification unit, and the voltage output unit may be configured to be mounted on a movable carriage.

The liquid ejecting apparatus may eject liquid, and includes a three-dimensional shaping apparatus (so-called 3D printer), a textile printing apparatus, or the like, in addition to a printing apparatus which will be described below.

In addition, the invention is not limited to a liquid ejecting apparatus, can be realized in various aspects, and can also be conceptualized by a drive circuit which drives a capacitive load, such as a piezoelectric element, a driving method, a head unit of the liquid ejecting apparatus, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings by using a printing apparatus as an example.

Figure 1:
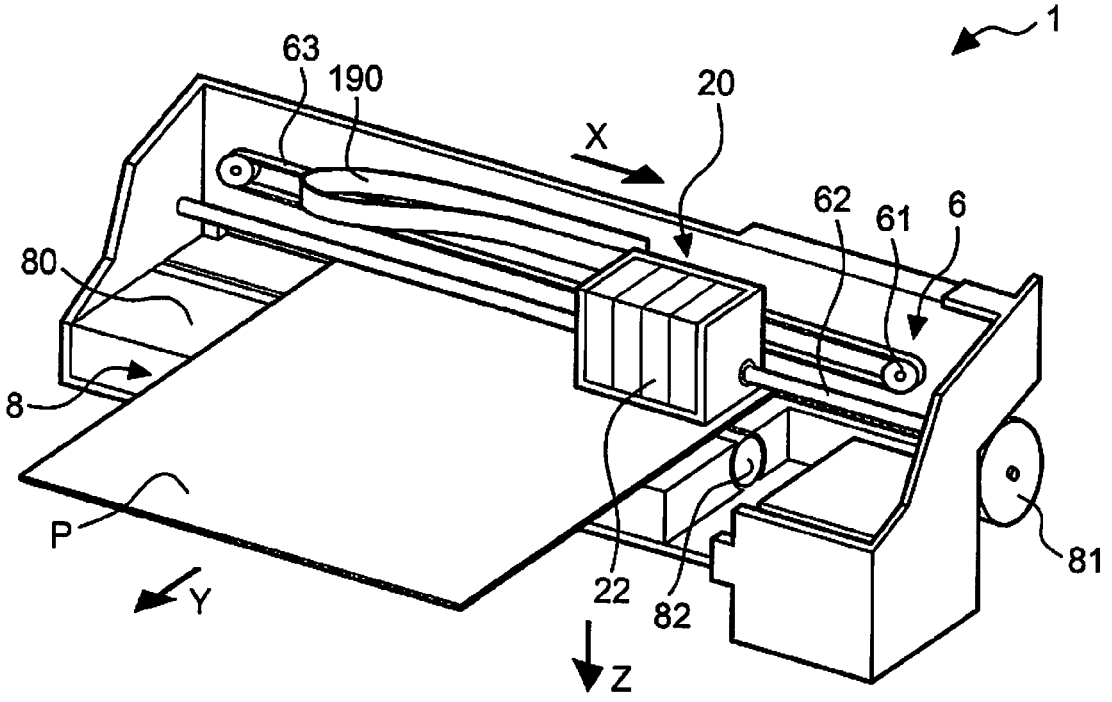
FIG. 1 is a view illustrating a schematic configuration of a printing apparatus (first apparatus).

FIG. 1 is a perspective view illustrating a schematic configuration of a printing apparatus (first apparatus).

The printing apparatus 1 (first apparatus) illustrated in FIG. 1 is a type of a liquid ejecting apparatus which ejects ink that is an example of liquid to form an ink dot group on a medium P such as paper, thereby, printing an image (including characters, graphics, or the like).

The printing apparatus has symbols unified by 1 for the sake of convenience, but there are several aspects as will be described later. For this reason, there is a case where parentheses including words are given instead of the symbols, such as a printing apparatus (first apparatus) or a printing apparatus (second apparatus) so as to distinguish from each other.

As illustrated in FIG. 1, the printing apparatus 1 includes a moving mechanism 6 which moves (moves back and forth) a carriage 20 in a main scanning direction (X direction).

The moving mechanism 6 includes a carriage motor 61 which moves the carriage 20, a carriage guide axis 62 both of which are fixed, and a timing belt 63 which extends substantially parallel to the carriage guide axis 62 and is driven by the carriage motor 61.

The carriage 20 is supported by the carriage guide axis 62 so as to move freely back and forth, and is fixed to a part of the timing belt 63. Accordingly, if the timing belt 63 travels forward and backward by the carriage motor 61, the carriage 20 is guided by the carriage guide axis 62 and moves back and forth.

A printing head 22 is mounted in the carriage 20. The printing head 22 includes multiple nozzles which respectively eject ink in the Z direction onto a portion which faces the medium P. The printing head 22 is divided into approximately four blocks for color printing. The four blocks respectively eject black (Bk) ink, cyan (C) ink, magenta (M) ink, and yellow (Y) ink.

There is provided a configuration in which various control signals or the like from a main substrate (omitted in FIG. 1) through a flexible flat cable 190, are supplied to the carriage 20.

The printing apparatus 1 includes a transport mechanism 8 which transports the medium P on a platen 80. The transport mechanism 8 includes a transport motor 81 which is a drive source, and a transport roller 82 which is rotated by the transport motor 81 and transports the medium P in a sub-scanning direction (Y direction).

In the configuration, an image is formed on a surface of the medium P by ejecting ink in accordance with print data from the nozzles of the printing head 22 in accordance with main scanning of the carriage 20, and repeating an operation of transporting the medium P in accordance with the transport mechanism 8.

In the present embodiment, the main scanning is performed by moving the carriage 20, but may be performed by moving the medium P, and may be performed by moving both the carriage 20 and the medium P. The point is that there may be provided a configuration in which the medium P and the carriage 20 (printing head 22) move relatively.

Figure 2:
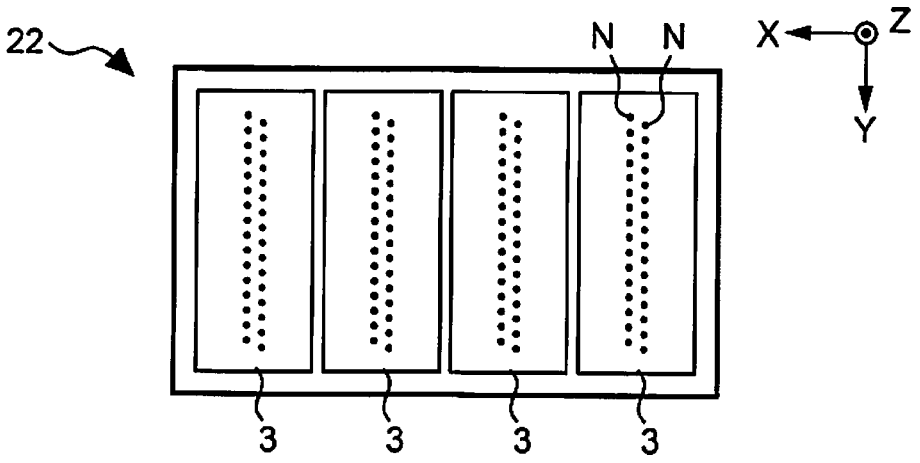
FIG. 2 is a diagram illustrating arrangement or the like of nozzles in a head unit of the printing apparatus.

FIG. 2 is a diagram illustrating a configuration in a case in which an ejecting surface of ink in the printing head 22 is viewed from the medium P. As illustrated in FIG. 2, the printing head 22 includes four head units 3. The four head units 3 are arranged in the X direction which is a main scanning direction in correspondence with black (Bk), cyan (C), magenta (M), and yellow (Y), respectively.

Figure 3:
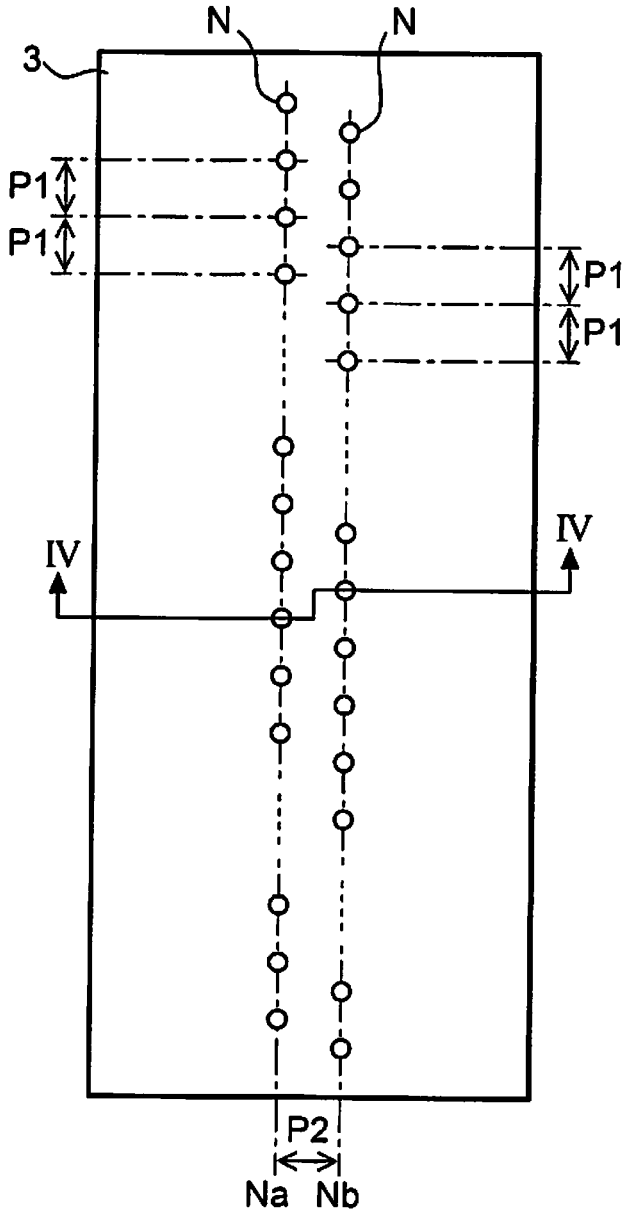
FIG. 3 is an enlarged diagram illustrating arrangement of the nozzles.

FIG. 3 is a diagram illustrating arrangement of nozzles in one head unit 3.

As illustrated in FIG. 3, multiple nozzles N are arranged in two columns in one head unit 3. For the sake of convenience, the two columns are respectively referred to as a nozzle column Na and a nozzle column Nb.

Multiple nozzles N are respectively arranged in the Y direction which is a subscan direction by a pitch P1 in the nozzle columns Na and Nb. In addition, the nozzle columns Na and Nb are separated from each other by a pitch P2 in the X direction. The nozzles N in the nozzle column Na are shifted from the nozzles N in the nozzle column Nb by half of the pitch P1 in the Y direction.

In this way, the nozzles N are arranged so as to be shifted by half of the pitch P1 in the two columns of the nozzle columns Na and Nb in the Y direction, and thereby it is possible to increase resolution in the Y direction substantially twice as much as a case of one column.

The number of nozzles N in one head unit 3 is referred to as m (m is an integer greater than or equal to 2) for the sake of convenience.

As will be described below, the head unit 3 is configured to include a circuit substrate on which various elements are mounted and which is coupled to an actuator substrate including m nozzles N and piezoelectric elements provided in correspondence with the m nozzles N. Hence, for the sake of convenience of description, a structure of the actuator substrate will be described.

In the present description, the coupling means direct and indirect coupling between two or more elements and includes a case where one or more intermediate elements exist between the two or more elements. In the above example, the circuit substrate is coupled to the actuator substrate through, for example, flexible printed circuits (FPC).

Figure 4:
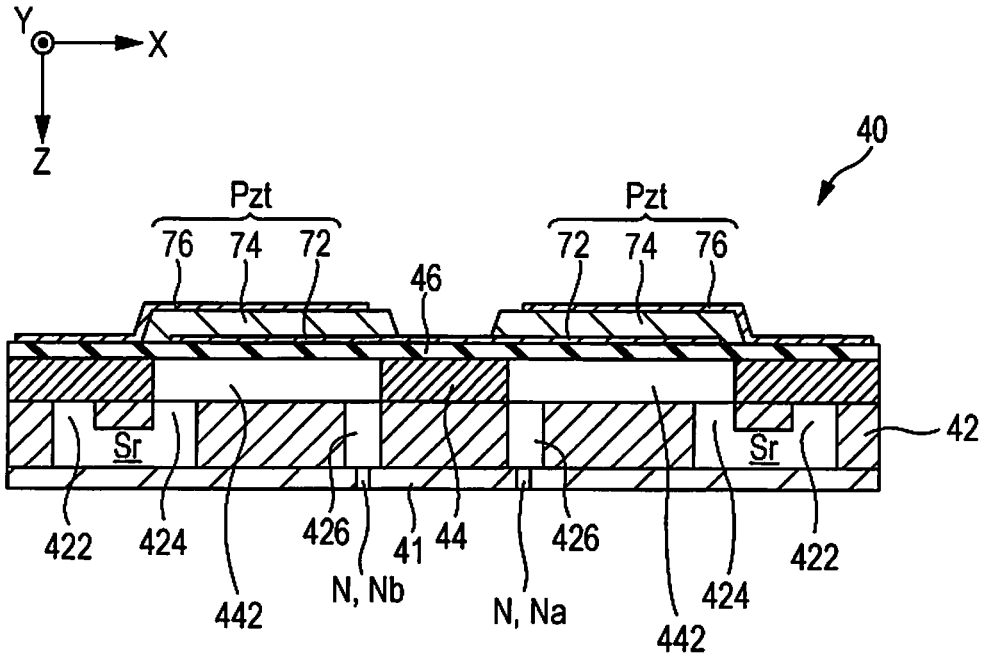
FIG. 4 is a sectional view illustrating an essential configuration of the head unit.

FIG. 4 is a sectional view illustrating a structure of the actuator substrate. In detail, FIG. 4 is a view illustrating a cross section taken along line IV-IV of FIG. 3.

As illustrated in FIG. 4, the actuator substrate 40 has a structure in which a pressure chamber substrate 44 and a vibration plate 46 are provided on a surface on a negative side in the Z direction and a nozzle plate 41 is provided on a surface on a positive side in the Z direction, in a flow path substrate 42.

Schematically, each element of the actuator substrate 40 is a member of an approximately flat plate which is long in the Y direction, and is fixed to each other by for example, an adhesive or the like. In addition, the flow path substrate 42 and the pressure chamber substrate 44 are formed by, for example, a single crystal substrate of silicon.

The nozzles N are formed in the nozzle plate 41. A structure corresponding to the nozzles in the nozzle column Na is shifted from a structure corresponding to the nozzles in the nozzle column Nb by half of the pitch P1 in the Y direction, but the nozzles are formed approximately symmetrically except for that, and thus, the structure of the actuator substrate 40 will be hereinafter described by focusing on the nozzle column Na.

The flow path substrate 42 is a flat member which forms a flow path of ink, and includes an opening 422, a supply flow path 424, and a communication flow path 426. The supply flow path 424 and the communication flow path 426 are formed in each nozzle, and the opening 422 is continuously formed over the multiple nozzles and has a structure in which ink with a corresponding color is supplied. The opening 422 functions as a liquid reservoir chamber Sr, and a bottom surface of the liquid reservoir chamber Sr is configured by, for example, the nozzle plate 41. In detail, the nozzle plate 41 is fixed to the bottom surface of the flow path substrate 42 so as to close the opening 422, the supply flow path 424, and the communication flow path 426 which are in the flow path substrate 42.

The vibration plate 46 is installed on a surface on a side opposite to the flow path substrate 42, in the pressure chamber substrate 44. The vibration plate 46 is a member of an elastically vibratile flat plate, and is configured by stacking an elastic film formed of an elastic material such as a silicon oxide, and an insulating film formed of an insulating material such as a zirconium oxide. The vibration plate 46 and the flow path substrate 42 face each other with an interval in the inner side of each opening 422 of the pressure chamber substrate 44. A space between the flow path substrate 42 and the vibration plate 46 in the inner side of each opening 422 functions as a cavity 442 which provides pressure to ink. Each cavity 442 communicates with the nozzle N through the communication flow path 426 of the flow path substrate 42.

A piezoelectric element Pzt is formed in each nozzle N (cavity 442) on a surface on a side opposite to the pressure chamber substrate 44 in the vibration plate 46.

The piezoelectric element Pzt includes a common drive electrode 72 formed over the multiple piezoelectric elements Pzt formed on a surface of the vibration plate 46, a piezoelectric body 74 formed on a surface of the drive electrode 72, and individual drive electrodes 76 formed in each piezoelectric element Pzt on a surface of the piezoelectric body 74. In the configuration, a region in which the piezoelectric body 74 is interposed between the drive electrode 72 and the drive electrode 76 which face each other, functions as the piezoelectric element Pzt.

The piezoelectric body 74 is formed in a process which includes, for example, a heating process (baking). In detail, the piezoelectric body 74 is formed by baking a piezoelectric material which is applied to a surface of the vibration plate 46 on which multiple drive electrodes 72 are formed, using heating processing of a furnace, and then molding (milling by using, for example, plasma) the baked material for each piezoelectric element Pzt.

In the same manner, the piezoelectric element Pzt corresponding to the nozzle column Nb is also configured to include the drive electrode 72, the piezoelectric body 74, and the drive electrode 76.

In addition, in this example, in the piezoelectric body 74, the common drive electrode 72 is used as a lower layer and the individual drive electrodes 76 are used as an upper layer, but in contrast to this, a configuration in which the common drive electrode 72 is used as an upper layer and the individual drive electrodes 76 are used as a lower layer, may be provided.

Meanwhile a voltage Vout of a drive signal according to the amount of ink to be ejected is individually applied from a circuit substrate to the drive electrode 76 which is a terminal of the piezoelectric element Pzt, a holding signal of a voltage $V_{BS}$ is commonly applied to the drive electrode 72 which is the other terminal of the piezoelectric element Pzt.

Accordingly, the piezoelectric element Pzt becomes displaced upwardly or downwardly in accordance with a voltage which is applied to the drive electrodes 72 and 76. In detail, if the voltage Vout of the drive signal which is applied through the drive electrode 76 decreases, the central portion of the piezoelectric element Pzt is bent upwardly with respect to both end portions, and meanwhile, if the voltage Vout increases, the central portion of the piezoelectric element Pzt is bent downwardly.

If the central portion is bent upwardly, an internal volume of the cavity 442 increases (pressure decreases), and thus ink is drawn from the liquid reservoir chamber Sr. Meanwhile, if the central portion is bent downwardly, an internal volume of the cavity 442 decreases (pressure increases), and thus, an ink droplet is ejected from the nozzle N in accordance with the decreased degree. In this way, if a proper drive signal is applied to the piezoelectric element Pzt, ink is ejected from the nozzle N in accordance with the displacement of the piezoelectric element Pzt. Accordingly, an ejecting unit, which ejects ink in accordance with at least the piezoelectric element Pzt, the cavity 442, and the nozzle N, is configured.

Next, an electrical configuration of the printing apparatus 1 will be described.

Figure 5:
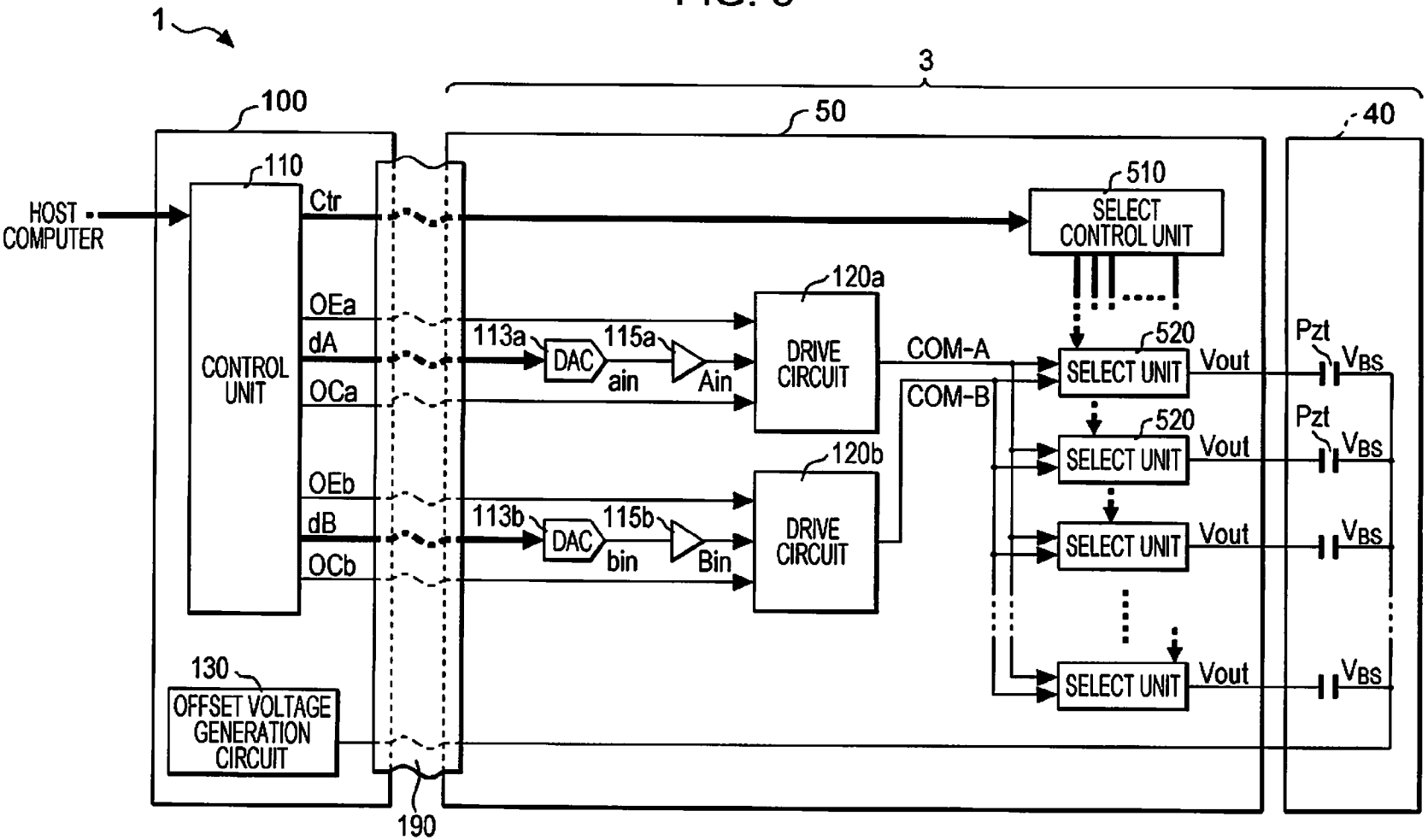
FIG. 5 is a block diagram illustrating an electrical configuration of the printing apparatus (first apparatus).

FIG. 5 is a block diagram illustrating an electrical configuration of the printing apparatus 1.

As illustrated in FIG. 5, the printing apparatus 1 has a configuration in which the head unit 3 is coupled to a main substrate 100 through a flexible flat cable 190. The head unit 3 is largely divided into the actuator substrate 40 and a circuit substrate 50.

The printing apparatus 1 includes four head units 3 and the main substrate 100 independently controls the four head units 3. The four head units 3 are the same as each other except that the colors of ink to be ejected are different from each other, and thus, hereinafter, one head unit 3 will be representatively described for the sake of convenience.

As illustrated in FIG. 5, the main substrate 100 includes a control unit 110 and an offset voltage generation circuit 130.

Among these, the control unit 110 is a type of a microcontroller having a CPU, a RAM, a ROM, and the like, and outputs each of various signals and the like for controlling each unit by executing a predetermined program, when image data which becomes a printing target is supplied from a host computer or the like.

Specifically, firstly, the control unit 110 supplies each of data dA and dB and signals OEa, OCa, OEb, and OCb to the circuit substrate 50.

Here, the data dA defines a drive signal COM-A. Each of the signals OEa and OCa goes to a logic level according to a voltage change of a waveform of the drive signal COM-A specified by the data dA, which will be described in detail below.

In the same manner, the data dB defines a drive signal COM-B. Each of the signals OEb and OCb goes to a logic level according to a voltage change of a waveform of the drive signal COM-B specified by the data dB, which will be described in detail below.

Secondly, the control unit 110 supplies various control signals Ctr to the head unit 3 in synchronization with control for the moving mechanism 6 and the transport mechanism 8. The control signal Ctr includes print data SI (ejection control signal) for defining the amount of ink which is ejected from the nozzle N, a clock signal Sck used for transferring print data, and signals LAT and CH for defining a print cycle and the like.

The control unit 110 controls the moving mechanism 6 and the transport mechanism 8, but since the configurations are known, description thereon will be omitted.

In addition, the offset voltage generation circuit 130 generates a holding signal of the voltage $V_{BS}$. The holding signal of the voltage $V_{BS}$ is commonly applied to other terminals of a plurality of piezoelectric elements Pzt on the actuator substrate 40 through a flexible flat cable 190 and the circuit substrate 50. The holding signal of the voltage $V_{BS}$ holds the other terminals of the plurality of piezoelectric elements Pzt in a constant state.

Meanwhile, the circuit substrate 50 in the head unit 3 includes D/A converters (DACs) 113*a* and 113*b*, voltage amplifiers 115*a* and 115*b*, drive circuits 120*a* and 120*b*, a select control unit 510, and select units 520 that corresponds one-to-one to the piezoelectric elements Pzt.

The DAC 113*a* converts the digital data dA into an analog signal ain. The voltage amplifier 115*a* amplifies a voltage of the signal ain by, for example, 10 times, and supplies the amplified signal as a signal Ain to the drive circuit 120*a*. In the same manner, the DAC 113*b* converts the digital data dB into an analog signal bin, the voltage amplifier 115*b* amplifies the voltage of the signal bin by, for example, 10 times, and supplies the amplified signal to the drive circuit 120*b* as the signal Bin.

The drive circuit 120*a* increases drive capability (convert into low impedance) of the signal Ain and the signals OEa and OCa to output as the drive signal COM-A, which will be described in detail below. In the same manner, the drive circuit 120*b* increases drive capability of the signal Bin and the signals OEb and OCb to output as the drive signal COM-B.

The drive signals COM-A and COM-B (signals ain and bin after analog conversion is performed, signals Ain and Bin before impedance conversion is performed) respectively have trapezoidal waveforms as will be described below.

The select control unit 510 controls selection of each of the select units 520. In detail, the select control unit 510 stores the print data which is supplied in synchronization with a clock signal from the control unit 110 by the amount of several nozzles (piezoelectric elements Pzt) of the head unit 3 once, and instructs each select unit 520 to select the drive signals COM-A and COM-B in accordance with the print data at a start timing of a print cycle which is defined by a timing signal.

Each select unit 520 selects (or does not select any one) one of the drive signals COM-A and COM-B in accordance with instruction of the select control unit 510, and applies the selected signal to one terminal of the corresponding piezoelectric element Pzt as a drive signal of the voltage Vout.

Since the signal ain (bin) is converted by the DAC 113*a* (113*b*) of a semiconductor integrated circuit with a low breakdown voltage, the signal ain (bin) swings at a relatively small amplitude of, for example, approximately 0 to 4 V. In contrast to this, the drive signal COM-A (COM-B), which is a combination source of the drive signals applied to the piezoelectric elements Pzt, requires a relatively large amplitude of a voltage of approximately 0 to 40 V for sufficiently driving the piezoelectric elements Pzt.

Accordingly, the voltage amplifier 115*a* (115*b*) amplifies the voltage of the signal ain (bin) converted by the DAC 113*a* (113*b*), the drive circuit 120*a* (120*b*) performs impedance conversion of the signal Ain (Bin) whose voltage is amplified to output as the drive signal COM-A (COM-B), and the select unit 520 corresponding to one piezoelectric element Pzt selects (or does not select) the drive signal COM-A or COM-B in accordance with the amount of ink to be ejected to apply to one end of the piezoelectric element Pzt.

Meanwhile, the actuator substrate 40 in the head unit 3 includes the piezoelectric elements Pzt, each being provided for each nozzle N as described with reference to FIG. 4. The other terminal of each of the piezoelectric elements Pzt is commonly coupled to each other, and the voltages $V_{BS}$ is applied to the other terminals by the offset voltage generation circuit 130.

In the head unit 3, the circuit substrate 50 is coupled to the actuator substrate 40, and elements, which configure the DACs 113*a* and 113*b*, the voltage amplifiers 115*a* and 115*b*, the drive circuits 120*a* and 120*b*, the select control unit 510, and the plurality of select units 520, are respectively mounted on the circuit substrate 50.

In the present embodiment, ink is ejected from one nozzle N maximum twice by one dot, and thus four gradations of a large dot, a medium dot, a small dot, and no record are represented. In the present embodiment, in order to represent the four gradations, two types of the drive signals COM-A and COM-B are prepared, and each cycle has first half pattern and a second half pattern. Then, during one cycle, the drive signals COM-A and COM-B are selected (or not selected) in accordance with a gradation to be represented in the first half and a second half, and the selected signal is supplied to the piezoelectric element Pzt.

Thus, the drive signals COM-A and COM-B will be first described, and thereafter, a detailed configuration of the select control unit 510 for selecting the drive signals COM-A and COM-B, and the select unit 520 will be described.

Figure 6:
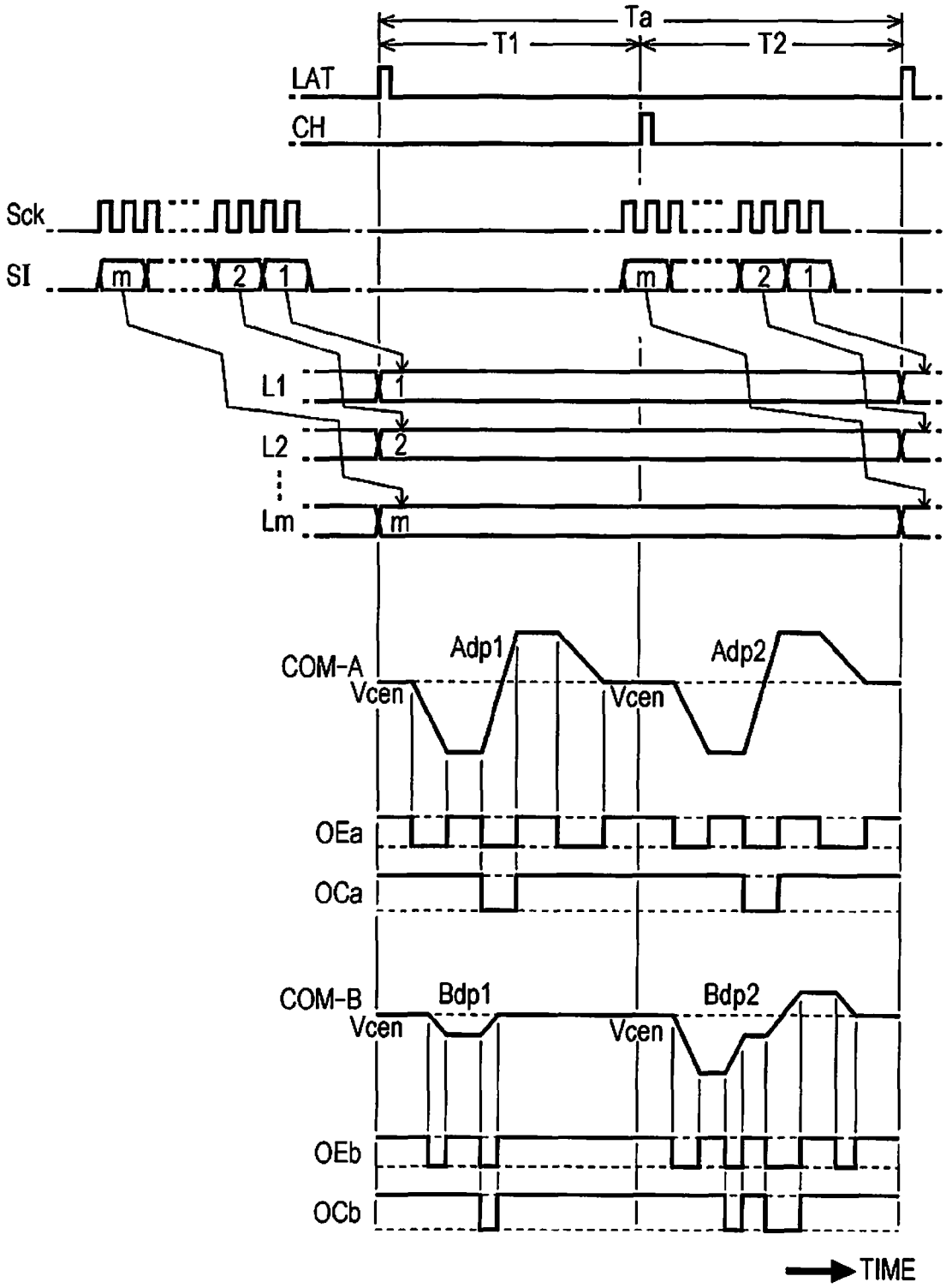
FIG. 6 is a diagram illustrating waveforms or the like of drive signals.

FIG. 6 is a diagram illustrating waveforms or the like of drive signals COM-A and COM-B.

As illustrated in FIG. 6, the drive signal COM-A is configured by a repeated waveform of a trapezoidal waveform Adp1 which is disposed during a period T1 from time when a control signal LAT is output (rises) to time when a control signal CH is output, during a print cycle Ta, and a trapezoidal waveform Adp2 which is disposed during a period T2 from time when the control signal CH is output and to the control signal LAT is output during the print cycle Ta.

In the present embodiment, the trapezoidal waveforms Adp1 and Adp2 are approximately the same waveforms as each other, and are waveforms which eject ink of a predetermined amount, specifically, an approximately medium amount from the nozzle N corresponding to the piezoelectric elements Pzt, if each waveform is supplied to the drive electrode 76 which is one terminal of the piezoelectric elements Pzt.

The drive signal COM-B is configured by a repeated waveform of a trapezoidal waveform Bdp1 which is disposed during the period T1 and a trapezoidal waveform Bdp2 which is disposed during the period T2. In the present embodiment, the trapezoidal waveforms Bdp1 and Bdp2 are waveforms different form each other. Among these, the trapezoidal waveform Bdp1 is a waveform for preventing an increase of viscosity of ink by slightly vibrating the ink near the nozzle N. Accordingly, even if the trapezoidal waveform Bdp1 is supplied to the one terminal of the piezoelectric element Pzt, ink is not ejected from the nozzle N corresponding to the piezoelectric element Pzt. In addition, the trapezoidal waveform Bdp2 is a waveform different from the trapezoidal waveform Adp1 (Adp2). If the trapezoidal waveform Bdp2 is supplied to the one terminal of the piezoelectric element Pzt, the trapezoidal waveform Bdp2 becomes a waveform which ejects the amount of ink less than the predetermined amount from the nozzle N corresponding to the piezoelectric element Pzt.

Voltages at a start timing of the trapezoidal waveforms Adp1, Adp2, Bdp1, and Bdp2, and voltages at an end timing of the trapezoidal waveforms Adp1, Adp2, Bdp1, and Bdp2 are all common at a voltage Vcen. That is, the trapezoidal waveforms Adp1, Adp2, Bdp1, and Bdp2 are waveforms which respectively start at the voltage Vcen and ends at the voltage Vcen.

Since the drive circuit 120*a* (120*b*) performs impedance conversion of the signal Ain (Bin) in the present example, a waveform of the signal Ain (Bin) which is input includes a slight error, but is the same as a waveform of the drive signal COM-A (COM-B). Meanwhile, since the signal Ain (Bin) is obtained by amplifying a voltage of the signal ain (bin) by 10 times, a waveform of the signal ain (bin) is in a relationship of 1/10 of the voltage of the signal Ain (Bin). Since the signal ain (bin) is obtained by analog conversion of the data dA (dB), a voltage waveform of the drive signal COM-A (COM-B) is defined by the control unit 110.

The control unit 110 supplies each of the signals OEa and OCa having the following logic levels to the drive circuit 120*a* in accordance with a trapezoidal waveform of the drive signal COM-A. In detail, firstly, the control unit 110 sets the signal OEa (designated signal) to an L level during a period in which the voltage of the drive signal COM-A (signal ain) decreases and a period in which the voltage of the drive signal COM-A (signal ain) increases, and sets the signal OEa to an H level during the other periods in which the voltage of the drive signal COM-A is constant. Secondly, the control unit 110 sets the signal OCa to an L level during the period in which the voltage of the drive signal COM-A increases and sets the signal OCa to an H level during the other periods.

Thereby, the signal OEa goes to an H level during the period in which the voltage is constant in the trapezoidal waveform of the drive signal COM-A, and the signal OEa goes to an L level during a period in which the voltage changes. Furthermore, the signal OCa goes to an H level during the period in which the voltage decreases, and the signal OCa goes to an L Level during the period in which the voltage increases, among the periods in which the voltage of the drive signal COM-A changes (that is, the period in which the signal OEa is at an L level).

In the same manner, the control unit 110 supplies each of the signals OEb and OCb having the following logic levels to the drive circuit 120*b* in accordance with a trapezoidal waveform of the drive signal COM-B. In detail, firstly, the control unit 110 sets the signal OEb to an L level during a period in which the voltage of the drive signal COM-B (signal bin) decreases and a period in which the voltage of the drive signal COM-B (signal bin) increases, and sets the signal OEb to an H level during the other periods in which the voltage of the drive signal COM-B is constant. Secondly, the control unit 110 sets the signal OCb to an L level during the period in which the voltage of the drive signal COM-B increases and sets the signal OCa to an H level during the other periods.

Thereby, the signal OEb goes to an H level during the period in which the voltage is constant in the trapezoidal waveform of the drive signal COM-B, and the signal OEb goes to an L level during a period in which the voltage changes. Furthermore, the signal OCb goes to an H level during the period in which the voltage decreases, and the signal OCb goes to an L Level during the period in which the voltage increases, among the periods in which the voltage of the drive signal COM-B changes (that is, the period in which the signal OEb is at an L level).

Figure 7:
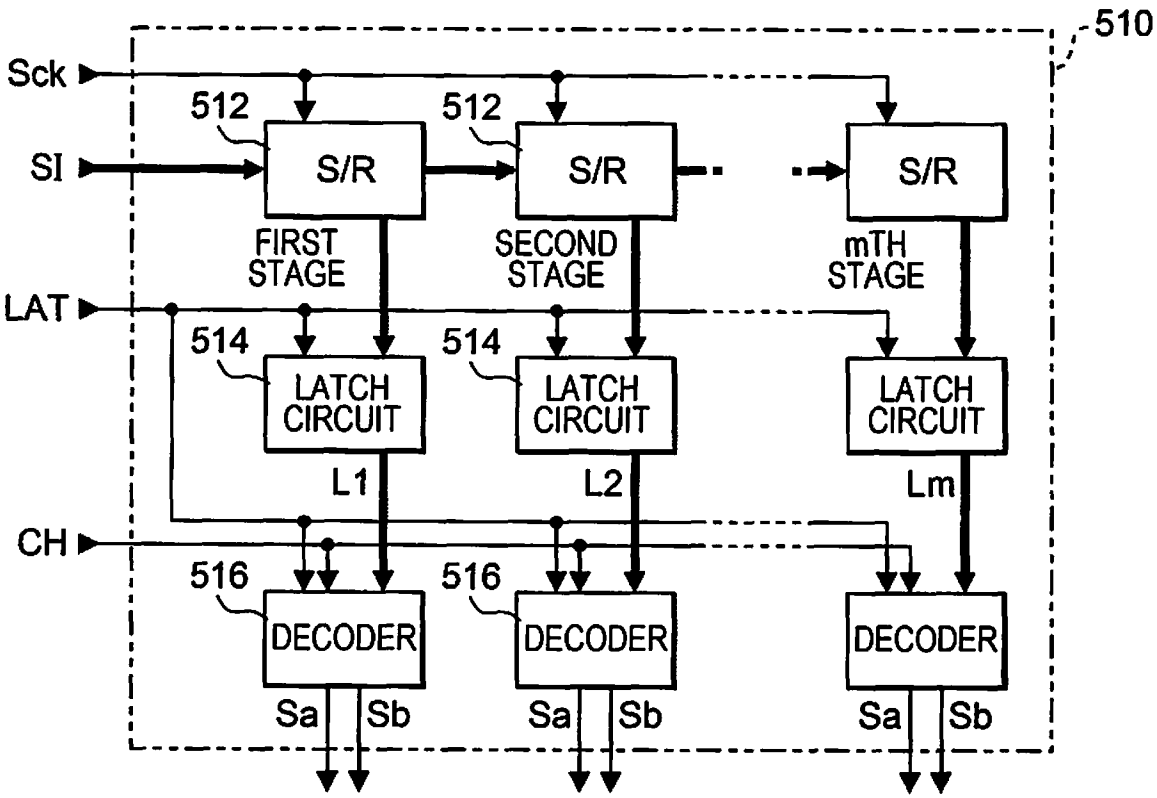
FIG. 7 is a diagram illustrating a configuration of a select control unit.

FIG. 7 is a diagram illustrating a configuration of the select control unit 510 of FIG. 5.

As illustrated in FIG. 7, a clock signal Sck, the print data SI, and the control signals LAT and CH are supplied to the select control unit 510. Multiple sets of a shift register (S/R) 512, a latch circuit 514, and a decoder 516 are provided in correspondence with each of the piezoelectric elements Pzt (nozzles N) in the select control unit 510.

The print data SI is data which defines dots to be formed by all the nozzles N in the head unit 3 which is focused during the print cycle Ta. In the present embodiment, in order to represent the four gradations of no record, a small dot, a medium dot, and a large dot, the print data for one nozzle is configured by two bits of a most significant bit (MSB) and a least significant bit (LSB).

The print data SI is supplied from the control unit 110 in accordance with transport of the medium P for each nozzle N (piezoelectric element Pzt) in synchronization with the clock signal Sck. The shift register 512 has a configuration in which the print data SI of two bits is retained once in correspondence with the nozzle N.

In detail, shift registers 512 of total m stages corresponding to each of m piezoelectric elements Pzt (nozzles) are coupled in cascade, and the print data SI which is supplied to the shift register 512 of a first stage located at a left end of FIG. 7 is sequentially transmitted to the rear stage (downward side) in accordance with the clock signal Sck.

In FIG. 7, in order to separate the shift registers 512, the shift register 512 are sequentially referred to as a first stage, a second stage, . . . , an mth stage from an upper side to which the print data SI is supplied.

The latch circuit 514 latches the print data SI retained in the shift register 512 at a rising edge of the control signal LAT.

The decoder 516 decodes the print data SI of two bits which are latched in the latch circuit 514, outputs select signals Sa and Sb for each of periods T1 and T2 which are defined by the control signal LAT and the control signal CH, and defines select of the select unit 520.

Figures 8, 9:
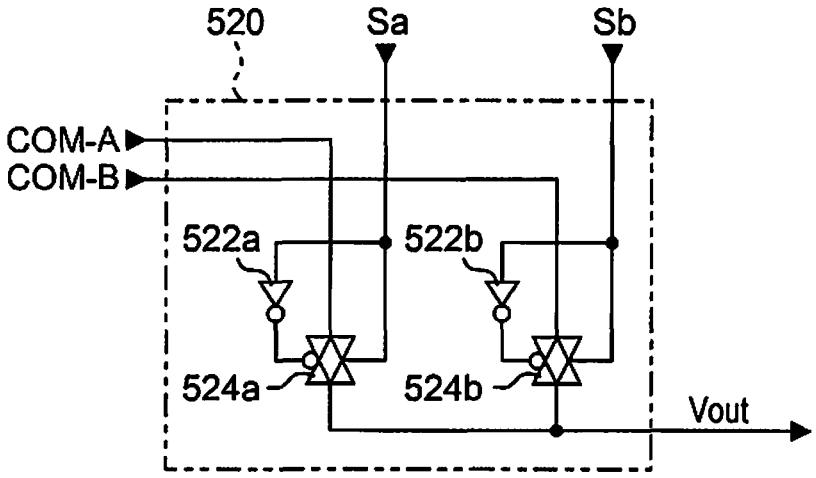
FIG. 8 is a diagram illustrating decoded contents of a decoder.
FIG. 9 is a diagram illustrating a configuration of a select unit.

FIG. 8 is a diagram illustrating decoded content of the decoder 516.

In FIG. 8, the print data SI of two bits which are latched is referred to as an MSB and an LSB. In the decoder 516, if the latched print data SI is (0,1), it means that logic levels of the select signals Sa and Sb are respectively output as levels of H and L during the period T1, and levels of L and H during the period T2.

The logic levels of the select signals Sa and Sb are level-shifted by a level shifter (not illustrated) to a higher amplitude logic than the logic levels of the clock signal Sck, the print data SI, and the control signals LAT and CH.

FIG. 9 is a diagram illustrating a configuration of the select unit 520 of FIG. 5.

As illustrated in FIG. 9, the select unit 520 includes inverters (NOT circuit) 522*a* and 522*b*, and transfer gates 524*a* and 524*b*.

The select signal Sa from the decoder 516 is supplied to a positive control terminal to which a round mark is not attached in the transfer gate 524*a*, is logically inverted by the inverter 522*a*, and is supplied to a negative control terminal to which a round mark is attached in the transfer gate 524*a*. In the same manner, the select signal Sb is supplied to a positive control terminal of the transfer gate 524*b*, is logically inverted by the inverter 522*b*, and is supplied to a negative control terminal of the transfer gate 524*b*.

The drive signal COM-A is supplied to an input terminal of the transfer gate 524*a*, and the drive signal COM-B is supplied to an input terminal of the transfer gate 524*b*. The output terminals of the transfer gates 524*a* and 524*b* are coupled to each other, and are coupled to one terminal of the corresponding piezoelectric element Pzt.

If the select signal Sa goes to an H level, the input terminal and the output terminal of the transfer gate 524*a* are electrically coupled (ON) to each other. If the select signal Sa goes to an L level, the input terminal and the output terminal of the transfer gate 524*a* are electrically decoupled (OFF) from each other. In the same manner, the input terminal and the output terminal of the transfer gate 524*b* are also electrically coupled to each other or decoupled from each other in accordance with the select signal Sb.

As illustrated in FIG. 6, the print data SI is supplied to each nozzle in synchronization with the clock signal Sck, and is sequentially transmitted to the shift registers 512 corresponding to the nozzles. Thus, if supply of the clock signal Sck is stopped, the print data SI corresponding to each nozzle is retained in each of the shift registers 512.

If the control signal LAT rises, each of the latch circuits 514 latches all of the print data SI retained in the shift registers 512. In FIG. 6, the number in L1, L2, . . . , Lm indicate the print data SI which is latched by the latch circuits 514 corresponding to the shift registers 512 of the first stage, the second stage, . . . , the mth stage.

The decoder 516 outputs the logic levels of the select signals Sa and Sb in the content illustrated in FIG. 8 in accordance with the size of the dots which are defined by the latched print data SI during the periods T1 and T2.

That is, first, the decoder 516 sets the select signals Sa and Sb to levels of H and L during the period T1 and levels of H and L even during the period T2, if the print data SI is (1,1) and the size of the large dot is defined. Second, the decoder 516 sets the select signals Sa and Sb to levels of H and L during the period T1 and levels of L and H during the period T2, if the print data SI is (0,1) and the size of the medium dot is defined. Third, the decoder 516 sets the select signals Sa and Sb to levels of L and L during the period T1 and levels of L and H during the period T2, if the print data SI is (1,0) and the size of the small dot is defined. Fourth, the decoder 516 sets the select signals Sa and Sb to levels of L and H during the period T1 and levels of L and L during the period T2, if the print data SI is (0,0) and no record is defined.

Figure 10:
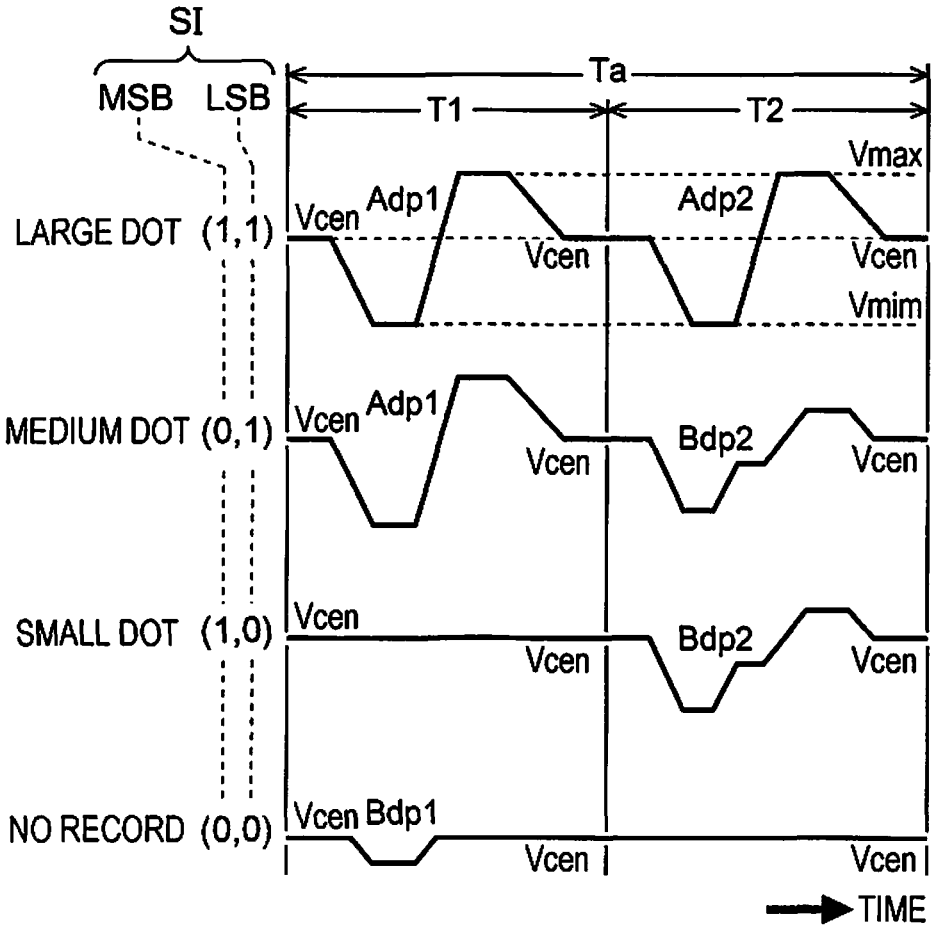
FIG. 10 is a diagram illustrating the drive signals supplied from the select unit to a piezoelectric element.

FIG. 10 is a diagram illustrating voltage waveforms of the drive signals which are selected in accordance with the print data SI and are supplied to one terminal of the piezoelectric element Pzt.

When the print data SI is (1,1), the select signals Sa and Sb become H and L levels during the period T1, and thus the transfer gate 524*a* is turned on, and the transfer gate 524*b* is turned off. Accordingly, the trapezoidal waveform Adp1 of the drive signal COM-A is selected during the period T1. Since the select signals Sa and Sb go to H and L levels even during the period T2, the select unit 520 selects the trapezoidal waveform Adp2 of the drive signal COM-A.

In this way, if the trapezoidal waveform Adp1 is selected during the period T1, the trapezoidal waveform Adp2 is selected during the period T2, and the selected waveforms are supplied to one terminal of the piezoelectric element Pzt as drive signals, ink of an approximately medium amount is ejected twice from the nozzle N corresponding to the piezoelectric element Pzt. Accordingly, each ink is landed on and combined with the medium P, and as a result, a large dot is formed as defined by the print data SI.

When the print data SI is (0,1), the select signals Sa and Sb become H and L levels during the period T1, and thus the transfer gate 524*a* is turned on, and the transfer gate 524*b* is turned off. Accordingly, the trapezoidal waveform Adp1 of the drive signal COM-A is selected during the period T1. Next, since the select signals Sa and Sb go to L and H levels during the period T2, the trapezoidal waveform Bdp2 of the drive signal COM-B is selected.

Hence, ink of an approximately medium amount and an approximately small amount is ejected twice from the nozzle N. Accordingly, each ink is landed on and combined with the medium P, and as a result, a medium dot is formed as defined by the print data SI.

When the print data SI is (1,0), the select signals Sa and Sb become all L levels during the period T1, and thus the transfer gates 524*a* and 524*b* are turned off. Accordingly, the trapezoidal waveforms Adp1 and Bdp1 are not selected during the period T1. If the transfer gates 524*a* and 524*b* are all turned off, a path from a coupling point of the output terminals of the transfer gates 524*a* and 524*b* to one terminal of the piezoelectric element Pzt becomes a high impedance state in which the path is not electrically coupled to any portion. However, both terminals of the piezoelectric element Pzt retain a voltage (Vcen-$V_{BS}$) shortly before the transfer gates are turned off, by capacitance included in the piezoelectric element Pzt itself.

Next, since the select signals Sa and Sb go to L and H levels during the period T2, the trapezoidal waveform Bdp2 of the drive signal COM-B is selected. Accordingly, ink of an approximately small amount is ejected from the nozzle N only during the period T2, and thus small dot is formed on the medium P as defined by the print data SI.

When the print data SI is (0,0), the select signals Sa and Sb become L and H levels during the period T1, and thus the transfer gates 524*a* is turned off and the transfer gate 524*b* is turned on. Accordingly, the trapezoidal waveforms Bdp1 of the drive signal COM-B is selected during the period T1. Next, since all of the select signals Sa and Sb go to L levels during the period T2, the trapezoidal waveforms Adp2 and Bdp2 are all not selected.

Accordingly, ink near the nozzle N just slightly vibrates during the period T1, and the ink is not ejected, and thus, as a result, dots are not formed, that is, no record is made as defined by the print data SI.

In this way, the select unit 520 selects (or does not select) the drive signals COM-A and COM-B in accordance with instruction of the select control unit 510, and applies the selected signal to one terminal of the piezoelectric element Pzt. Accordingly, each of the piezoelectric elements Pzt is driven in accordance with the size of the dot which is defined by the print data SI.

The drive signals COM-A and COM-B illustrated in FIG. 6 are just an example. Actually, combinations of various waveforms which are prepared in advance are used in accordance with properties, transport speed, or the like of the medium P.

In addition, here, an example in which the piezoelectric element Pzt is bent upwardly in accordance with a decrease of a voltage is used, but if a voltage which is applied to the drive electrodes 72 and 76 is inverted, the piezoelectric element Pzt is bent downwardly in accordance with a decrease of the voltage. Accordingly, in a configuration in which the piezoelectric element Pzt is bent downwardly in accordance with a decrease of a voltage, the drive signals COM-A and COM-B illustrated in the figure have waveforms which are inverted by using the voltage Vcen as a reference.

Next, the drive circuits 120*a* and 120*b* in the circuit substrate 50 will be described.

Since there are several aspects in the drive circuits 120*a* and 120*b*, there is a case where parentheses including words are given instead of the symbols, such as the drive circuit (first circuit) or the drive circuit (second circuit) so as to distinguish from each other in the same manner as the printing apparatus.

First, the drive circuit (first circuit) will be described by using the drive circuit 120*a* on the side where the drive signal COM-A is output as an example.

Figure 11:
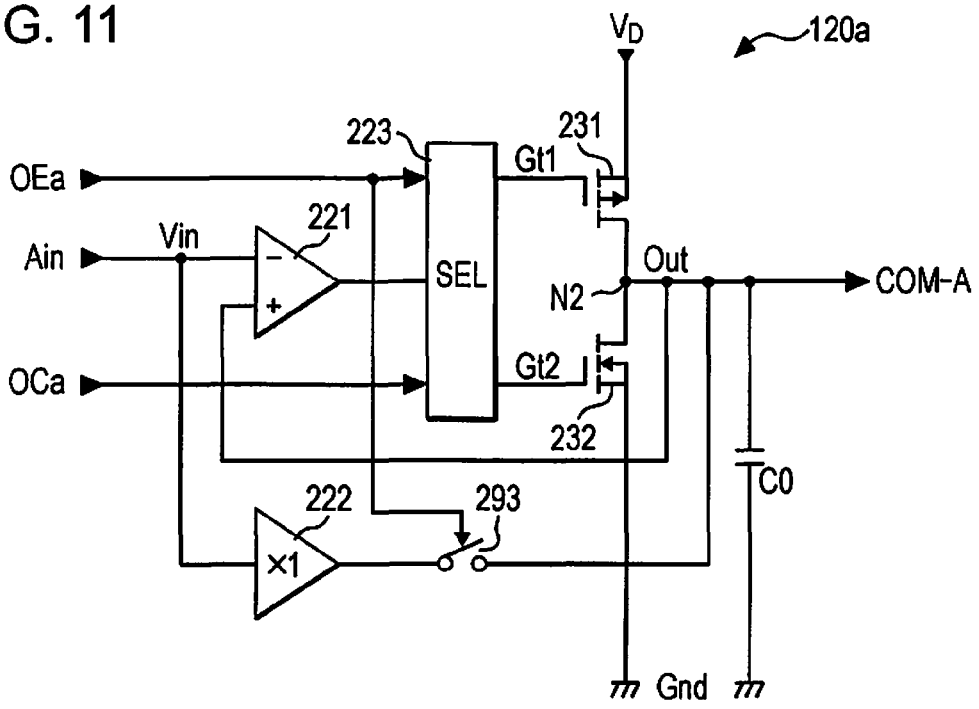
FIG. 11 is a diagram illustrating a configuration of a drive circuit (first circuit) applied to the printing apparatus (first apparatus).

FIG. 11 is a diagram illustrating the drive circuit (first circuit). As illustrated in FIG. 11, the drive circuit 120*a* includes a differential amplifier 221, a linear amplifier 222, a selector 223, a pair of transistors, a switch 293, and a capacitor C0.

The differential amplifier 221 has a negative input terminal (−) to which the signal Ain is supplied, and has a positive input terminal (+) to which the drive signal COM-A is fed back that is an output. Accordingly, the differential amplifier 221 amplifies a differential voltage obtained by subtracting a voltage of the negative input terminal (1) from a voltage of the positive input terminal (+), that is, a differential voltage obtained by subtracting a voltage Vin of the signal Ain (original drive signal) with a large amplitude which is an input from a voltage Out of the drive signal COM-A which is an output, and outputs the differential voltage.

While not illustrated in particular, for example, a high side of the power supply is set to a voltage $V_D$ (=42 V) and a low side thereof is set to a ground Gnd (=0 V), in the differential amplifier 221. Accordingly, an output voltage ranges from the ground Gnd to the voltage $V_D$.

However, an output signal of the differential amplifier 221 is a binary logic signal of an H level (voltage $V_D$) and an L level (ground Gnd) since being used to switch the pair of transistors in the present embodiment.

In addition, since there is a case where the original drive signal is voltage-amplified to be output as the drive signal while the drive signal is fed back after a voltage thereof decreases as will be described below, it may be said that a signal based on the drive signal is fed back to the differential amplifier 221.

If the signal OEa is at an L level and the signal OCa is at an L level, the selector (select unit) 223 selects the output signal of the differential amplifier 221 as a signal Gt1 to supply to a gate terminal of the transistor 231 and selects the L level as a signal Gt2 to supply to a gate terminal of the transistor 232.

Meanwhile, if the signal OEa is at an L level and the signal OCa is at an H level, the selector 223 selects the H level as the signal Gt1 to supply to the gate terminal of the transistor 231, and selects the output signal of the differential amplifier 221 as the signal Gt2 to supply to the gate terminal of the transistor 232.

If the signal OEa is at an H level, the selector 223 supplies the H level to the gate terminal of the transistor 231 as the signal Gt1 and supplies the L level to the gate terminal of the transistor 232 as the signal Gt2, regardless of a logic level of the signal OCa.

In other words, firstly, if the drive signal COM-A (signal Ain) is in a voltage increasing period, the selector 223 supplies the output signal of the differential amplifier 221 to the gate terminal of the transistor 231, and supplies a signal for turning off the transistor 232 to the gate terminal of the transistor 232. Secondly, if the drive signal COM-A is in a voltage decreasing period, the selector 223 supplies a signal for turning off the transistor 231 to the gate terminal of the transistor 231 and supplies the output signal of the differential amplifier 221 to the gate terminal of the transistor 232. Thirdly, if the drive signal COM-A is in a flat voltage period, the selector 223 supplies a signal for turning off the transistor 231 to the gate terminal of the transistor 231 and supplies a signal for turning of the transistor 232 to the gate terminal of the transistor 232.

The pair of transistors are configured by transistors 231 and 232. Among those, a high side transistor 231 (a high side transistor) is, for example, a P-channel type field effect transistor, and the high side voltage $V_D$ of the power supply is applied to a source terminal thereof. A low side transistor 232 (a low side transistor) is, for example, an N-channel type field effect transistor, and a source terminal thereof is coupled to the ground Gnd which is a lower side of the power supply.

Drain terminals of the transistors 231 and 232 are coupled to each other and serve as a node N2 which is an output terminal of the drive circuit 120*a*. That is, the drive signal COM-A is configured to output from the node N2.

A voltage of the node N2 which is an output of the drive circuit 120*a* is denoted as Out and a voltage of the signal Ain which is an input thereof is denoted as Vin.

The linear amplifier 222 amplifies the voltage Vin of the signal Ain by a voltage amplification factor of one time and outputs the amplified voltage in the present embodiment.

The switch 293 is an example of a variable resistor, is located between the output terminal of the linear amplifier 222 and the node N2, is turned on if the signal OEa is at an H level, and is turned off if the signal OEa is at an L level.

The node N2 is coupled to the positive input terminal (+) of the differential amplifier 221.

In addition, the capacitor C0 is provided for preventing abnormal oscillation from occurring or the like, one terminal thereof is coupled to the node N2 and the other terminal thereof is coupled to a constant potential, for example, the ground Gnd.

An amplification unit, which amplifies the signal Ain to output toward the node N2, is conceptualized by the differential amplifier 221, the selector 223, and the transistors 231 and 232. A voltage output unit, which outputs a voltage corresponding to the signal Ain toward the node N2 during a period in which a magnitude of a voltage change of the signal Ain is less than or equal to a threshold, is conceptualized by the linear amplifier 221 and the switch 293.

Here, the drive circuit 120*a* which outputs the drive signal COM-A is described, but a configuration of the drive circuit 120*b* that outputs the drive signal COM-B is the same as that of the drive circuit 120*a*, and only input and output signals are different. That is, while the drive circuit 120*b* receives the signal OEb instead of the signal OEa, the signal OCb instead of the signal OCa, and the signal Bin instead of the signal Ain, the drive signal COM-B is configured to output from the node N2.

Next, operations of the drive circuits 120*a* and 120*b* will be described by using the drive circuit 120*a* which outputs the drive signal COM-A as an example.

Figure 12:
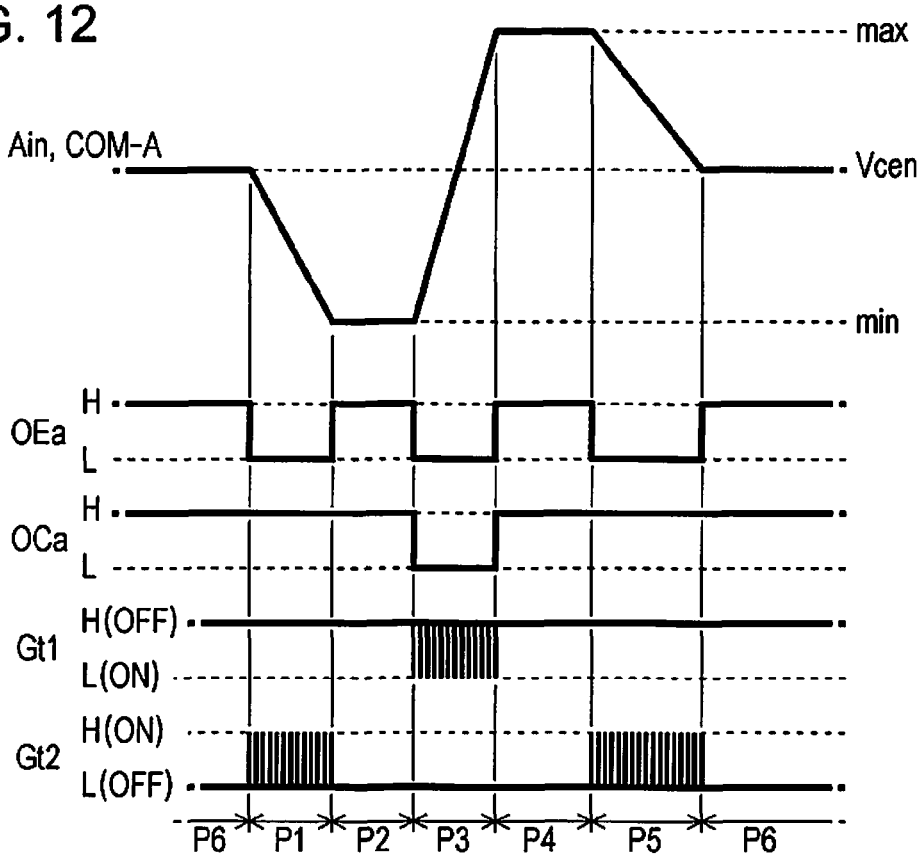
FIG. 12 is a diagram illustrating an operation of the drive circuit (first circuit).

FIG. 12 is a diagram illustrating voltage waveforms of various units for describing the operation of the drive circuit 120*a*.

In FIG. 12, the signal Ain is a signal which is input before impedance conversion of the drive signal COM-A is performed, and thus, the signal Ain has approximately the same waveform as the drive signal COM-A. In addition, as described above, since the drive signal COM-A has two identical trapezoidal waveforms Adp1 and Adp2 repeated during the print cycle Ta, the signal Ain also has the same waveform which is repeated.

FIG. 12 illustrates one trapezoidal waveform of the waveforms which are repeated. In addition, in FIG. 12, a period P1 is a period in which the voltage Vin of the signal Ain decreases from the voltage Vcen to a minimum value min, and a period P2 following the period P1 is a period in which the voltage Vin is constant at the minimum value min, a period P3 following the period P2 is a period in which the voltage Vin increases from the minimum value min to a maximum value max, a period P4 following the period P3 is a period in which the voltage Vin is constant at the maximum value max, and a period P5 following the period P4 is a period in which the voltage Vin decreases from the maximum value max to the voltage Vcen.

A vertical scale is not always aligned for each of the plurality of voltage waveforms in FIG. 12, for the sake of convenient description.

First, the period P1 is a voltage decreasing period of the drive signal COM-A (Ain). Accordingly, the signal OEa is at an L level and the signal OCa is at an H level during the period P1, and thus, the selector 223 selects the H level as the signal Gt1 and selects an output signal of the differential amplifier 221 as the signal Gt2.

Since the signal Gt1 is at an H level during the period P1, the P-channel type transistor 231 is turned off.

Meanwhile, the voltage Vin of the signal Ain first decreases more than the voltage Out of the node N2 during the period P1. In other words, the voltage Out is higher than or equal to the voltage Vin. Accordingly, a voltage of the output signal of the differential amplifier 221 which is selected as the signal Gt2 increases in accordance with a differential voltage between both terminals and approximately jumps to an H level. If the signal Gt2 goes to an H level, the transistor 232 is turned on, and thereby, the voltage Out decreases. The voltage Out does not actually decreases to the ground Gnd at once due to the capacitor C0 and capacitance of the piezoelectric element Pzt which is a load, and decreases slowly.

If the voltage Out is lower than the voltage Vin, the signal Gt2 goes to an L level, and the transistor 232 is turned off. Although the transistor 232 is turned off, the voltage of the node N2 is retained by the capacitor C0 and capacitances of the piezoelectric element Pzt, thereby, being not unstable.

If the transistor 232 is turned off, decrease of the voltage Out of the node N2 is stopped, but since the voltage Vin continuously decreases, the voltage Out is higher than or equal to the voltage Vin again. Accordingly, the signal Gt2 goes to an H level, and the transistor 232 is turned on again.

The signal Gt2 is alternately switched to an H level and an L level during the period P1, and thereby, the transistor 232 performs an operation of repeating turn-on and turn-off, that is, a switching operation. By the switching operation, the voltage Out is controlled to follow decrease of the voltage Vin.

Next, the period P2 is a period in which the drive signal COM-A (Ain) is constant at the minimum value min. Accordingly, since the signal OEa is at an H level during the period P2, the selector 223 selects the H level as the signal Gt1 and selects the L level as the signal Gt2, and as a result, both the transistors 231 and 232 are turned off.

Meanwhile, since the signal OEa is at an H level, the switch 293 is turned on, and as a result, an output signal of the linear amplifier 222, that is, a signal obtained by amplifying the voltage Vin of the signal Ain by one time is supplied to the node N2. Accordingly, the voltage Out becomes the voltage Vin.

The period P3 is a voltage increasing period of the drive signal COM-A (Ain). Accordingly, the signal OEa goes to an L level and the signal OCa goes to an L level during the period P3, and thereby, the selector 223 selects the output signal of the differential amplifier 221 as the signal Gt1 and selects the L level as the signal Gt2.

Since the signal Gt2 is at an L level during the period P3, the N-channel type transistor 232 is turned off.

Meanwhile, the voltage Vin increases prior to the voltage Out during the period P3. In other words, the voltage Out decreased more than the voltage Vin. Accordingly, a voltage of the output signal of the differential amplifier 221 selected as the signal Gt1 decreases in accordance with the differential voltage between both terminals and approximately jumps to an L level. If the signal Gt1 goes to an L level, the transistor 231 is turned on, and thereby, the voltage Out increases. The voltage Out does not actually increases to the voltage $V_D$ at once due to the capacitor C0 and the piezoelectric element Pzt, and decreases slowly.

If the voltage Out is higher than or equal to the voltage Vin, the signal Gt2 goes to an H level, and the transistor 231 is turned off. Although the transistor 231 is turned off, the voltage of the node N2 is retained by the capacitor C0 and the capacitances of the piezoelectric element Pzt, thereby, being not unstable.

If the transistor 231 is turned off, increase of the voltage Out is stopped, but since the voltage Vin continuously increases, the voltage Out is lower than the voltage Vin again. Accordingly, the signal Gt1 goes to an L level, and the transistor 231 is turned on again.

The signal Gt1 is alternately switched to an H level and an L level during the period P3, and thereby, the transistor 231 performs the switching operation. By the switching operation, the voltage Out is controlled to follow increase of the voltage Vin.

The period P4 is a period in which the drive signal COM-A (Ain) is constant at a maximum value max. Accordingly, since the signal OEa is at an H level during the period P4, the selector 223 selects the H level as the signal Gt1 and selects the L level as the signal Gt2, and as a result, both the transistors 231 and 232 are turned off.

Meanwhile, since the signal OEa is at an H level, the switch 293 is turned on, and as a result, the signal obtained by amplifying the voltage Vin of the signal Ain by one time is supplied to the node N2 by the linear amplifier 222. Accordingly, the voltage Out becomes the voltage Vin.

The period P5 is a voltage decreasing period of the drive signal COM-A (Ain). Accordingly, the same operation as in the period P1 is performed during the period P5. That is, the signal Gt2 is alternately switched to an H level and an L level, and thereby, the transistor 232 performs the switching operation and the voltage Out is controlled to follow decrease of the voltage Vin.

A period P6 after the period P5 is a period in which the drive signal COM-A (Ain) is constant at the voltage Vcen. Accordingly, since the signal OEa is at an H level during the period P6, the selector 223 selects the H level as the signal Gt1 and selects the L level as the signal Gt2, and as a result, both the transistors 231 and 232 are turned off.

Meanwhile, since the signal OEa is at an H level, the switch 293 is turned on, and as a result, the signal obtained by amplifying the voltage Vin of the signal Ain by one time is supplied to the node N2 by the linear amplifier 222. Accordingly, the voltage Out becomes the voltage Vin, that is, the voltage Vcen during the period P6.

According to the drive circuit 120*a* illustrated in FIG. 11, the following operation is performed during each of the periods P1 to P6.

That is, the voltage Out is controlled to follow the voltage Vin during the periods P1 and P5 in which the voltage Vin decreases by the switching operation of the transistor 232, and the voltage Out is controlled to follow the voltage Vin during the period P3 in which the voltage Vin increases by the switching operation of the transistor 231.

In addition, the voltage Vin of the signal Ain is amplified by the linear amplifier 222 instead of the transistors 231 and 232 by a voltage amplification factor of one time and is output as the voltage Out during the periods P2, P4, and P6 in which the voltage Vin is constant.

According to the drive circuit 120*a*, the transistors 231 and 232 do not perform the switching operation during the periods P2, P4, and P6 in which the voltage Vin is constant, as compared with D class amplification in which switching is always performed. In addition, an a low pass filter (LPF) which demodulates a switching signal, particularly an inductor such as a coil is required in the D class amplification, but such the drive circuit 120*a* does not require the LPF. Accordingly, according to the drive circuit 120*a*, it is possible to reduce power consumed in the switching operation and the LPF, compared to the D class amplification, and to simplify and miniaturize a circuit.

In addition, the voltage Out is controlled to follow decrease of the voltage Vin by the switching operation of the transistor 231 or 232 during a voltage changing period of the drive signal COM-A (Ain).

Meanwhile, both the transistors 231 and 232 are turned off during a constant voltage period of the drive signal COM-A (Ain), but the switch 293 is turned on, and the linear amplifier 222 amplifies the signal Ain by a voltage amplification factor of one time and outputs the amplified signal to the node N2 as the voltage Out. Accordingly, although the transistors 231 and 232 are turned off, the voltage Out of the node N2 is stabilized at the voltage Vin.

Particularly, when the drive signal COM-A changes to a constant voltage period (in detail, when the signal OEa changes from an L level to an H level), the switching operation stops, and both the transistors 231 and 232 are turned off. There is a case in which shortly after the switching operation stops, the voltage Out does not coincide with the voltage Vin, unless any action is taken.

In contrast to this, in the present embodiment, shortly after the switching operation of the transistor 231 or 232 stops, although the voltage Out does not coincide with the voltage Vin, the voltage is corrected to immediately coincide with the voltage Vin by an output signal of the linear amplifier 222.

Since a load of the drive circuit 120*a* is the capacitor C0 and the piezoelectric element Pzt, a current is zero if a voltage is constant. Accordingly, the linear amplifier 222 does not require high drive capability, thereby, being easily miniaturized and integrated.

The drive signal COM-A (COM-B) is not limited to a trapezoidal waveform, and may be a waveform with tilted continuity such as a sinusoidal wave. For example, in case where the drive circuit 120*a* outputs such a waveform, if a change of the voltage Vout (voltage Vin of the signal Ain) of the drive signal COM-A is relatively large, specifically, if a voltage change per unit time exceeds a predetermined threshold, the signal OEa may be set to an L level, that is, the signal OCa may be set to an H level during time when a voltage decreases, and the signal OCa may be set to an L level during time when the voltage increases.

In addition, if the change of the voltage Vout (voltage Vin of the signal Ain) of the drive signal COM-A is relatively small, specifically, if the voltage change per unit time is less than or equal to the threshold, the signal OEa may be set to an H level.

If the signal OEa is at an H level, the output signal of the linear amplifier 222 becomes the drive signal COM-A, and thereby, the linear amplifier 222 requires a slightly higher drive capability as compared with a case where the drive signal COM-A (signal Ain) is a trapezoidal waveform.

Here, the switch 293 is exemplified as a variable resistor, but may be an element or a circuit whose resistance value is switched in accordance with the signal OEa. In detail, the variable resistor may have a relatively high resistance when the signal OEa is at an L level and may have a relatively low resistance when the signal OEa is at an H level.

In addition, here, the drive circuit 120*a* that outputs the drive signal COM-A is described as an example, but the same operation is also performed for the drive circuit 120*b* that outputs the drive signal COM-B. In detail, the waveform of the drive signal COM-B, and the signals OEb and OCb related to the waveform are the same as the description with reference to FIG. 6, and the drive circuit 120*b* also performs an operation of outputting the drive signal COM-B of the voltage Vout which follows the voltage of the signal Bin.

However, the configuration illustrated in FIG. 11 requires the switch 293 turned on or off in accordance with a logic level of the signal OEa, and there is room for improvement in simplifying the configuration. Hence, next, a drive circuit (second circuit) having another configuration in which that point is improved will be described.

Figure 13:
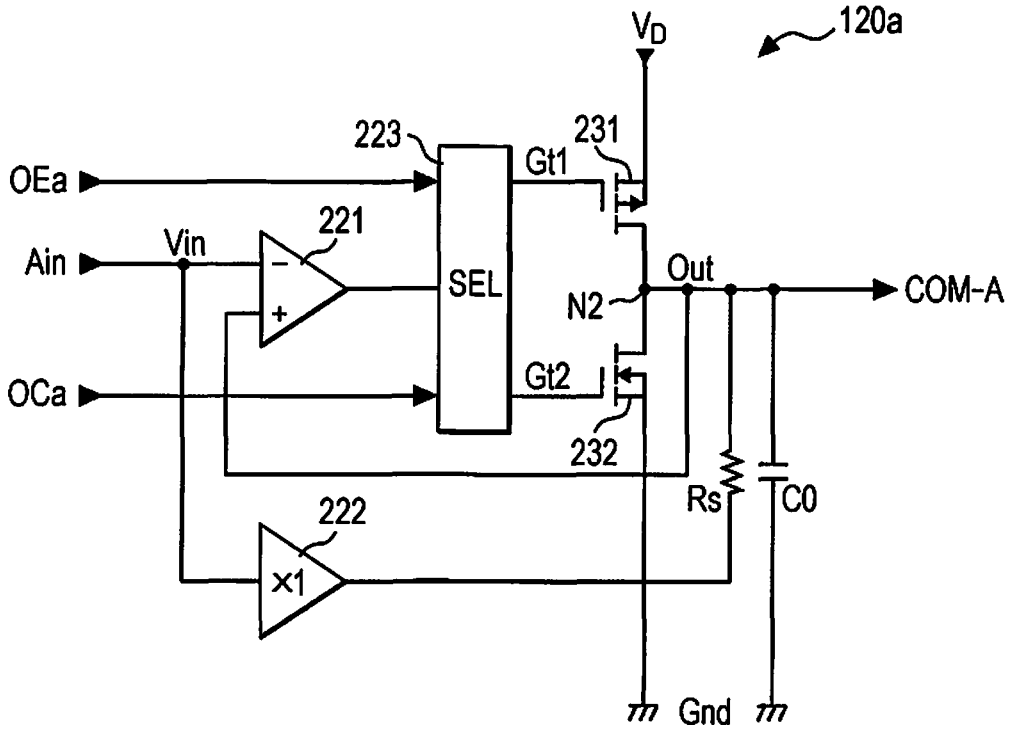
FIG. 13 is a diagram illustrating the drive circuit (second circuit).

FIG. 13 is a diagram illustrating a configuration of the drive circuit (second circuit). The drive circuit (second circuit) illustrated in FIG. 13 is different from the drive circuit (first circuit) illustrated in FIG. 11 in that a resistance element Rs is provided instead of the switch 293.

As for the drive circuit 120*a* that outputs the drive signal COM-A, the drive circuit (first circuit) has the configuration in which the switch 293 is turned on in case where the signal OEa is at an H level and the output signal of the linear amplifier 222 is supplied to the node N2 only during the period in which the switch 293 is turned on. In contrast to this, the drive circuit (second circuit) has a configuration in which the output signal of the linear amplifier 222 is supplied to the node N2 all the time regardless of a logic level of the signal OEa.

When the transistor 231 or 232 performs an switching operation, a potential difference is generated between the node N2 and the output terminal of the linear amplifier 222, and thereby, if the resistance element Rs is not provided, a large current flows in a direction from the node N2 to the output terminal of the linear amplifier 222, or in a direction from the output terminal of the linear amplifier 222 to the node N2. In contrast to this, by providing the resistive element Rs, the large current is prevented from flowing between the node N2 and the output terminal of the linear amplifier 230, and thus, it is possible to prevent the linear amplifier from being broken down.

According to the drive circuit (second circuit), the switch 293 configured by a transistor or the like is not required and only the resistance element Rs is required, as compared with the drive circuit (first circuit) illustrated in FIG. 11, and thus, it is possible to simplify the configuration.

The signals OEa and OCa (OEb and OCb) are not output by the control unit 110, and can be generated by another circuit by analyzing data dA (dB) output from the control unit 110 as follows.

For example, in case where discrete values (data) adjacent to each other in time are compared with each other with respect to the data dA (dB) and as a result the discrete values are equal to each other, the data is in a constant voltage period, and thus, another circuit may output each of the signals OEa and OCa (OEb and OCb) at an H level. In addition, in case where the discrete values adjacent to each other in time are compared with each other with respect to the data dA (dB) and as a result the discrete values are different from each other, the data is in a voltage increasing period in case where a subsequent discrete value in time is higher than a prior discrete value in time when a voltage conversion is performed, and thus, another circuit outputs each of the signals OEa and OCa (OEb and OCb) at an L level. Meanwhile, in case where a subsequent discrete value in time is lower than a prior discrete value in time when a voltage conversion is performed, the data is in a voltage decreasing period, and thus, another circuit may output the signal OEa (OEb) at an L level and output the signal OCa (OCb) at an H level.

Hence, in the drive circuit (first circuit and second circuit), a pair of transistors 231 and 232 operate in accordance with a voltage amplitude of the drive signal COM-A (COM-B) by using the power supply voltages ($V_D$ and Gnd). As described above, since the voltage of the drive signal COM-A is approximately maximum 40 volts, the selector 223 and the differential amplifier 221 requires a high breakdown voltage. The reason is that it is necessary to supply the signal Gt1 to the gate terminal of the transistor 231 and to supply the signal Gt2 to the gate terminal of the transistor 232.

Hence, next, a drive circuit (third circuit) having another configuration in which that point is improved will be described.

Figure 14:
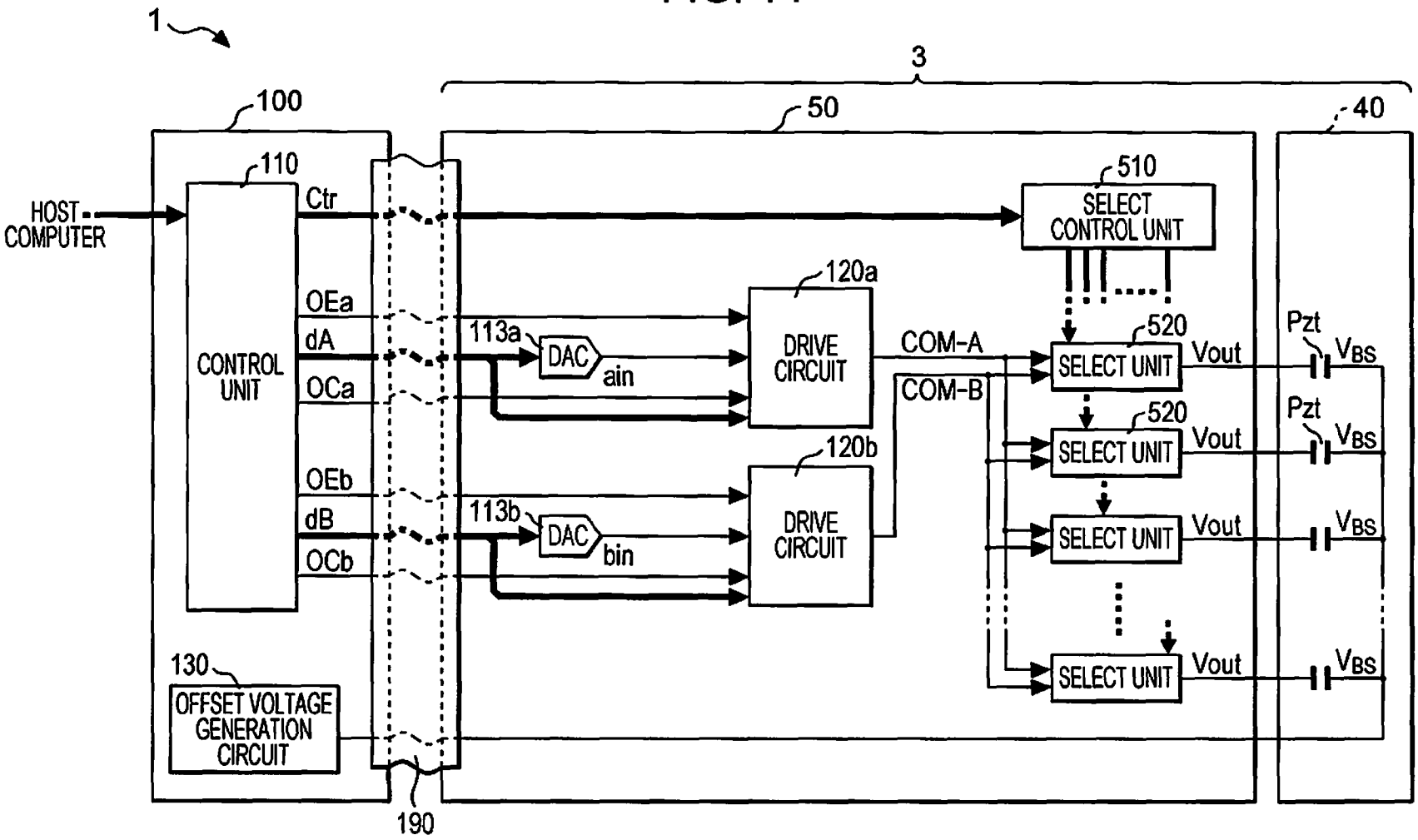
FIG. 14 is a block diagram illustrating an electrical configuration of a printing apparatus (second apparatus).

FIG. 14 is a block diagram illustrating an electrical configuration of the printing apparatus (second apparatus) including the drive circuit (third circuit). The printing apparatus (second apparatus) illustrated in FIG. 14 is different from the printing apparatus (first apparatus) illustrated in FIG. 5 in that, firstly, voltage amplifiers 115*a* and 115*b* are not provided. Accordingly, the signal ain with a small amplitude which is an output of the DAC 113*a* is supplied to the drive circuit 120*a*, and the signal bin with a small amplitude which is an output of the DAC 113*b* is supplied to the drive circuit 120*b*. In addition, a different point is that, secondly, the data dA is supplied to the drive circuit 120*a* and the data dB is supplied to the drive circuit 120*b*.

Figure 15:
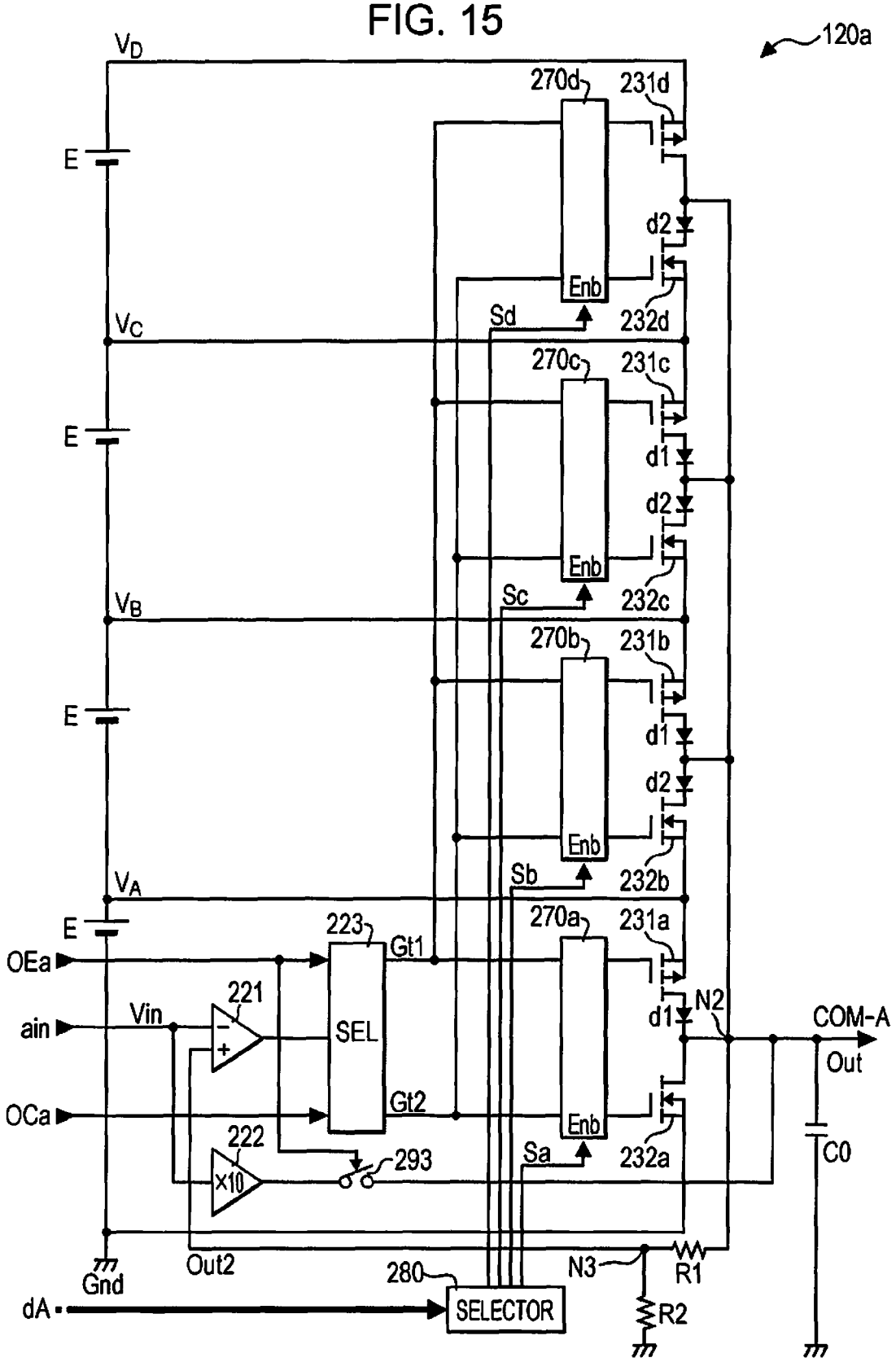
FIG. 15 is a diagram illustrating a drive circuit (third circuit) applied to the printing apparatus (second apparatus).

FIG. 15 is a diagram illustrating a configuration of the drive circuit (third circuit).

The drive circuit (third circuit) will be described by using the drive circuit 120*a* that outputs the drive signal COM-A as an example.

As illustrated in FIG. 15, the drive circuit 120*a* includes gate selectors 270*a*, 270*b*, 270*c*, and 270*d*, a selector 280, four pairs of transistor, and resistance elements R1 and R2, in addition to the four reference power supplies E, the differential amplifier 221, the linear amplifier 222, the selector 223, the switch 293, and the capacitor C0.

In the drive circuit (third circuit), voltages E, 2E, 3E, and 4E are respectively output as voltages $V_A$, $V_B$, $V_C$, and $V_D$ by four-stage series coupling of reference power supplies that respectively output the voltage E.

Figure 16:
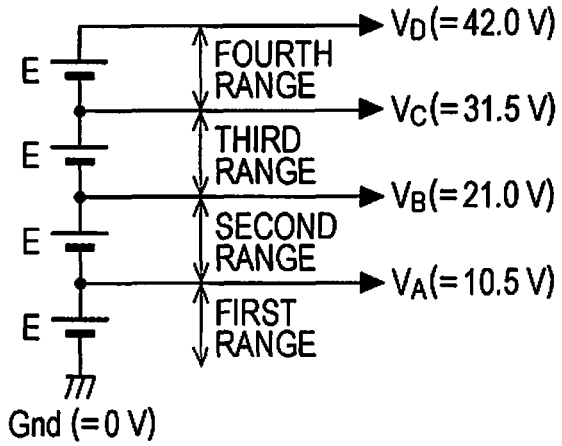
FIG. 16 is a diagram illustrating a voltage range of a drive circuit (third circuit).

FIG. 16 is a diagram illustrating the voltages $V_A$, $V_B$, $V_C$, and $V_D$.

As illustrated in FIG. 16, when the voltage E is set to, for example, 10.5 V, the voltages $V_A$, $V_B$, $V_C$, and $V_D$ respectively becomes 10.5 V, 21.0 V, 31.5 V, and 42.0 V. In the present embodiment, the following voltage ranges are defined by the voltages $V_A$, $V_B$, $V_C$, and $V_D$. That is, a range that is higher than or equal to the ground Gnd of a zero voltage and is lower than the voltage $V_A$ is defined as a first range, a range that is higher than or equal to the voltage $V_A$ and is lower than the voltage $V_B$ is defined as a second range, a range that is higher than or equal to the voltage $V_D$ and is lower than the voltage $V_C$ is defined as a third range, and a range that is higher than or equal to the voltage $V_C$ and is lower than the voltage $V_D$ is defined as a fourth range.

Returning to the description of FIG. 15, the signal ain with a small amplitude is supplied to a negative input terminal (−) of the differential amplifier 221, while a voltage Out2 of the node N3 is applied to a positive input terminal (+) thereof. Accordingly, the differential amplifier 221 amplifies a differential voltage obtained by subtracting the voltage Vin of the signal ain which is an input from the voltage Out2 and outputs the amplified voltage.

Unlike the drive circuit (first circuit), the differential amplifier 221 in the drive circuit (third circuit) sets a high side of the power supply as the voltage $V_A$. Accordingly, an output voltage of the differential amplifier 221 is in a range from the ground Gnd to the voltage $V_A$.

The selector 223 in the drive circuit (third circuit) has the same relationship of signals which are selected as the signals Gt1 and Gt2 with respect to the signals OEa and OCa as in the drive circuit (first circuit). That is, if the signal OEa is at an L level and the signal OCa is at an L level, the selector 223 in the drive circuit (third circuit) selects the output signal of the differential amplifier 221 as the signal Gt1 and selects the L level as the signal Gt2. Meanwhile, if the signal OEa is at an L level and the signal OCa is at an H level, the selector 223 in the drive circuit (third circuit) selects the H level as the signal Gt1 and selects the output signal of the differential amplifier 221 as the signal Gt2. If the signal OEa is at an H level, the selector 223 selects the H level as the signal Gt1 and selects the L level as the signal Gt2 regardless of a logic level of the signal OCa.

However, the selector 223 in the drive circuit (third circuit) sets the high side of the power supply as the voltage $V_A$ while not illustrated. Accordingly, when the output signal of the differential amplifier 221 is selected, the output voltage of the selector 223 is in a range from the ground Gnd to the voltage $V_A$, the H level becomes the voltage $V_A$, and the L level becomes the ground Gnd.

The selector 280 discriminates a range of the voltage Vin of the signal ain, from the data dA which is supplied from the control unit 110 (refer to FIG. 14), and outputs select signals Sa, Sb, Sc, and Sd in accordance with the discrimination result as follows.

In detail, in a case where the voltage Vin which is defined by the data dA is discriminated to be higher than or equal to 0 V and lower than 1.05 V, that is, in a case where a voltage at the time of amplifying the voltage Vin by 10 times is included in the first range, the selector 280 sets only the select signal Sa to an H level, and sets the other select signals Sb, Sc, and Sd to an L level. In addition, in a case where the voltage Vin which is defined by the data dA is discriminated to be higher than or equal to 1.05 V and lower than 2.10 V, that is, in a case where a voltage at the time of amplifying the voltage Vin by 10 times is included in the second range, the selector 280 sets only the select signal Sb to an H level, and sets the other select signals Sa, Sc, and Sd to an L level. In the same manner, in a case where the voltage Vin which is defined by the data dA is discriminated to be higher than or equal to 2.10 V and lower than 3.15 V, that is, in a case where a voltage at the time of amplifying the voltage Vin by 10 times is included in the third range, the selector 280 sets only the select signal Sc to an H level, and sets the other select signals Sa, Sb, and Sd to an L level. In a case where the voltage Vin is discriminated to be higher than or equal to 3.15 V and lower than 4.20 V, that is, in a case where a voltage at the time of amplifying the voltage Vin by 10 times is included in the fourth range, the selector 280 sets only the select signal Sd to an H level, and sets the other select signals Sa, Sb, and Sc to an L level.

Here, for the sake of convenient description, four pairs of transistors will be described.

In the example, the four pairs of transistors are configured by a pair of transistors 231*a* and 232*a*, a pair of transistors 231*b* and 232*b*, a pair of transistors 231*c* and 232*c*, and a pair of transistors 231*d* and 232*d*.

Among the total eight transistors configuring the four pairs of transistors, the transistors 231*a*, 231*b*, 231*c*, an 231*d* on a high side are, for example, P-channel type field effect transistors, and the transistors 232*a*, 232*b*, 232*c*, an 232*d* on a low side are, for example, N-channel type field effect transistors.

In the transistor 231*a*, the voltage $V_A$ is applied to a source terminal thereof, and a drain terminal thereof is coupled to the node N2. In the transistor 232*a*, a source terminal thereof is coupled to the ground Gnd, and a drain terminal thereof is coupled to the node N2 in common.

In the same manner, in the transistor 231*b* (231*c*, 231*d*), the voltage $V_B$ ($V_C$, $V_D$) is applied to a source terminal thereof, and a drain terminal thereof is coupled to the node N2. In the transistor 232*b* (232*c*, 232*d*), the voltage $V_A$ ($V_B$, $V_C$) is applied to a source terminal thereof, and a drain terminal thereof is coupled to the node N2 in common.

For example, in case where the transistor 231*a* is set to a first high side transistor, the transistor 232*a* is set to a first low side transistor, and the transistors 231*a* and 232*a* are set to a first transistor pair, the transistor 231*b* becomes a second high side transistor, the transistor 232*b* becomes a second low side transistor, and the transistors 231*b* and 232*b* become a second transistor pair.

Detailed description will be made below, but when the gate selector 270*a* is enabled, if the signal OEa is at an L level, the transistor 231*a* or 232*a* performs a switching operation and the voltage $V_A$ or the ground Gnd is applied to the node N2. In the same manner, when the gate selector 270*b* is enabled, if the signal OEa is at an L level, the transistor 231*b* or 232*b* performs a switching operation, the voltage $V_B$ or $V_A$ is applied to the node N2, and the gate selector 270*c* is enabled. When the gate selector 270*c* is enabled, if the signal OEa is at an L level, the transistor 231*c* or 232*c* performs a switching operation, the voltage $V_C$ or $V_B$ is applied to the node N2. When the gate selector 270*d* is enabled, if the signal OEa is at an L level, the transistor 231*d* or 232*d* performs a switching operation, and the voltage $V_D$ or $V_C$ is applied to the node N2.

The linear amplifier 222 in the drive circuit (third circuit) outputs the voltage Vin of the signal Ain by a voltage amplification factor of 10 times, unlike the drive circuits (first circuit and second circuit).

The switch 293 is the same as the switches in the drive circuits (first circuit and second circuit) in that the switch 293 is turned on if the signal OEa is at an H level between the output terminal of the linear amplifier 222 and the node N2, and is turned off if the signal OEa is at an L level.

The gate selector 270*a* uses the ground Gnd and the voltage $V_A$ as the power supply, and when the select signal Sa supplied to an input terminal Enb goes to an H level and thereby the gate selector 270*a* is enabled, each of the signals Gt1 and Gt2 output from the selector 223 is level-shifted to be supplied to the gate terminal of the transistor 231*a* and the gate terminal of the transistor 232*a*. In detail, when being enabled, the gate selector 270*a* level-shifts the range from the lowest voltage to the highest voltage of the signal Gt1 to the first range from the ground Gnd of the power supply to the voltage $V_A$ so as to supply the voltage to the gate terminal of the transistor 231*a*, and level-shifts the range from the lowest voltage to the highest voltage of the signal Gt2 to the first range so as to supply the voltage to the gate terminal of the transistor 232*a*.

Since the range from the lowest voltage to the highest voltage of the signals Gt1 and Gt2 coincides with the first range, when being enabled, the gate selector 270*a* shifts (as it is) the signal Gt1 by 0 V to supply to the gate terminal of the transistor 231*a*, and shifts the signal Gt2 by 0 V to supply to the gate terminal of the transistor 232*a*.

The gate selector 270*b* uses the voltages $V_A$ and $V_B$ as the power supply, when being enabled, the gate selector 270*b* level-shifts the range from the lowest voltage of the signal Gt1 to the highest voltage to the second range from the voltage $V_A$ of the power supply to the voltage $V_B$ and supplies the voltage to the gate terminal of the transistor 231*b*, and level-shifts the range from the lowest voltage of the signal Gt2 to the highest voltage to the second range and supplies the voltage to the gate terminal of the transistor 232*b*. That is, if it is limited to the gate selector 270*b*, when being enabled, the gate selector 270*b* adds 10.5 V to the signal Gt1 and supplies the signal to the gate terminal of the transistor 231*b*, and adds 10.5 V to the signal Gt2 and supplies the signal to the gate terminal of the transistor 232*b*.

In the same manner, the gate selector 270*c* uses the voltages $V_B$ and $V_C$ as the power supply, when being enabled, the gate selector 270*c* level-shifts the range from the lowest voltage of the signal Gt1 to the highest voltage to the third range from the voltage $V_B$ of the power supply to the voltage $V_C$ and supplies the voltage to the gate terminal of the transistor 231*c*, and level-shifts the range from the lowest voltage of the signal Gt2 to the highest voltage to the third range and supplies the voltage to the gate terminal of the transistor 232*c*. That is, if it is limited to the gate selector 270*c*, when being enabled, the gate selector 270*c* adds 21.0 V to the signal Gt1 and supplies the signal to the gate terminal of the transistor 231*c*, and adds 21.0 V to the signal Gt2 and supplies the signal to the gate terminal of the transistor 232*c*.

In the same manner, the gate selector 270*d* uses the voltages $V_C$ and $V_D$ as the power supply, when being enabled, the gate selector 270*d* level-shifts the range from the lowest voltage of the signal Gt1 to the highest voltage to the fourth range from the voltage $V_C$ of the power supply to the voltage $V_D$ and supplies the voltage to the gate terminal of the transistor 231*d*, and level-shifts the range from the lowest voltage of the signal Gt2 to the highest voltage to the fourth range and supplies the voltage to the gate terminal of the transistor 232*d*. That is, if it is limited to the gate selector 270*d*, when being enabled, the gate selector 270*d* adds 31.5 V to the signal Gt1 and supplies the signal to the gate terminal of the transistor 231*d*, and adds 31.5 V to the signal Gt2 and supplies the signal to the gate terminal of the transistor 232*d*.

When select signals supplied to input terminals Enb of the gate selectors 270*a*, 270*b*, 270*c*, and 270*d* go to an L level and thereby the gate selectors are disabled, the gate selectors output signals which respectively turn off two transistors corresponding to each of them. That is, if being disabled, the gate selectors 270*a*, 270*b*, 270*c*, and 270*d* forcibly convert the signal Gt1 to an H level and forcibly convert the signal Gt2 to an L level.

Here, the H and L levels are respectively the high side voltage and the low side voltage of the power supply of the gate selectors 270*a*, 270*b*, 270*c*, and 270*d*. For example, since the gate selector 270*b* uses the voltage $V_B$ and the voltage $V_A$ as the power supply, the voltage $V_B$ on the high side is at an H level and the voltage $V_A$ on a low side is at an L level.

The drive signal COM-A from the node N2 is fed back to the positive input terminal (+) of the differential amplifier 221 through the resistance element R1. In this example, for the sake of convenience, the positive input terminal (+) of the differential amplifier 221 is referred to as the node N3, and meanwhile, a voltage of the node N3 is referred to as Out2.

The node N3 is coupled to the ground Gnd through the resistance element R2. Accordingly, the voltage Out2 of the node N3 is obtained by dividing a voltage of the voltage Out of the node N2 by a ratio which is defined by resistance values of the resistance elements R1 and R2, that is, R2/(R1+R2). In the present embodiment, a dropped division voltage ratio is set to 1/10. In other words, the voltage Out2 is in a relationship of 1/10 of the voltage Out.

Diodes d1 and d2 are used for blocking reverse currents. A forward direction of the diode d1 is a direction toward the node N2 from the drain terminals of the transistors 231*a*, 231*b*, and 231*c*, and a forward direction of the diode d2 is a direction toward the drain terminals of the transistors 231*b*, 231*c*, and 231*d* from the node N2.

The voltage Out of the node N2 is not higher than the voltage $V_D$, and thus, it is not necessary to consider a reverse current. Accordingly, the diode d1 is not provided for the transistor 231*d*. In the same manner, the voltage Out of the node N2 is not lower than the ground Gnd of zero volts, and thus, the diode d2 is not provided for the transistor 232*a*.

An operation of the drive circuit (third circuit) will be described.

Figure 17:
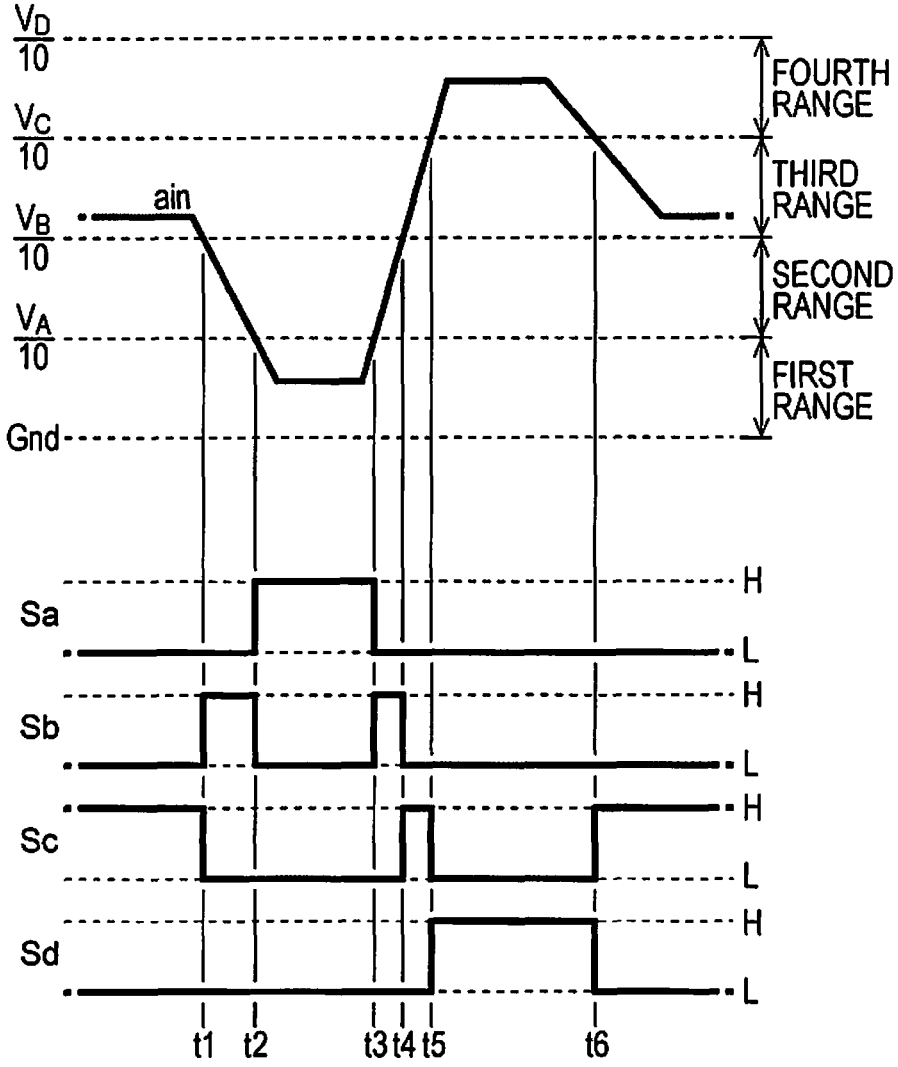
FIG. 17 is a diagram illustrating an operation of the drive circuit (third circuit).

FIG. 17 is a diagram illustrating the operation of the drive circuit (third circuit). In addition, as illustrated in FIG. 17, the signal ain has a different form from the drive signal COM-A, is a signal with a small amplitude shortly after analog conversion is performed by DAC113*a*, and is in a relationship of 1/10 of the voltage of the drive signal COM-A.

Accordingly, in a case where the first range to the fourth range which are defined by the voltages $V_A$, $V_B$, $V_C$, and $V_D$ are converted into a voltage range of the signal ain, the ranges are defined by the voltages $V_A/10$, $V_B/10$, $V_C/10$, and $V_D/10$. In detail, in the signal ain, a range higher than or equal to 0 V and lower than $V_A/10$ (=1.05 V) corresponds to the first range, a range higher than or equal to $V_A/10$ and lower than $V_B/10$ (=2.10 V) corresponds to the second range, a range higher than or equal to $V_B/10$ and lower than $V_C/10$ (=3.15 V) corresponds to the third range, and a range higher than or equal to $V_C/10$ and lower than $V_D/10$ (=4.20 V) corresponds to the fourth range.

In case where the voltage Vin of the signal ain is in the first range, the selector 280 sets only the select signal Sa to an H level and sets the other select signals Sb, Sc, and Sd to an L level. Thereby, the gate selector 270*a* is enabled and the other gate selectors 270*b*, 270*c*, and 270*d* are disabled. In this case, if the voltage Vin is constant, the signal OEa goes to an H level, and thereby, the switch 293 is turned on and the transistors 231*a* and 232*a* are turned off. Accordingly, the voltage Out output as the drive signal COM-A from the node N2 becomes a voltage obtained by amplifying the voltage Vin by 10 times using the linear amplifier 222.

Meanwhile, if the voltage Vin decreases, the signal OEa goes to an L level and the signal OCa goes to an L level, and thereby, the transistor 231*a* performs a switching operation in response to the signal Gt1 output from the differential amplifier 221. In addition, if the voltage Vin increases, the signal OEa goes to an L level and the signal OCa goes to an L level, and thereby, the transistor 232*a* performs a switching operation in response to the signal Gt2 output from the differential amplifier 221.

A voltage of the node N3 obtained by decreasing the voltage Out of the node N2 to 1/10 using the resistance elements R1 and R2 is controlled to follow the voltage Vin by the switching operation of the transistor 231*a* or 232*a*. In other words, the voltage Out is controlled to become a voltage obtained by amplifying the voltage Vin by 10 times.

Anyway, in case where the voltage Vin is in the first range, the voltage Out is output from the node N2 as a voltage obtained by amplifying the voltage Vin by 10 times by the linear amplifier 222 and the transistor 231*a* or 232*a*.

In addition, in case where the voltage Vin of the signal ain is in the second range, the selector 280 sets only the select signal Sb to an H level and sets the other select signals Sa, Sc, and Sd to an L level. Thereby, the gate selector 270*b* is enabled and the other gate selectors 270*a*, 270*c*, and 270*d* are disabled. In this case, if the voltage Vin is constant, the voltage Out becomes a voltage obtained by amplifying the voltage Vin by 10 times using the linear amplifier 222.

Meanwhile, if the voltage Vin decreases, the transistor 231*b* performs a switching operation, and if the voltage Vin increases, the transistor 232*b* performs a switching operation, and thereby, the voltage Out is controlled to become a voltage obtained by amplifying the voltage Vin by 10 times.

Hence, even in case where the voltage Vin is in the second range, the voltage Out is output as a voltage obtained by amplifying the voltage Vin by 10 times using the linear amplifier 222 and the transistor 231*b* or 232*b*.

In the same manner, in case where the voltage Vin of the signal ain is in the third range, the selector 280 sets only the select signal Sc to an H level and thereby, the gate selector 270*c* is enabled. Accordingly, the voltage Out is output as a voltage obtained by amplifying the voltage Vin by 10 times using the linear amplifier 222 and the transistor 231*c* or 232*c*.

In case where the voltage Vin of the signal ain is in the fourth range, the selector 280 sets only the select signal Sd to an H level and thereby, the gate selector 270*d* is enabled. Accordingly, the voltage Out is output as a voltage obtained by amplifying the voltage Vin by 10 times using the linear amplifier 222 and the transistor 231*d* or 232*d*.

In this way, the voltage Out is output to become a voltage obtained by amplifying the voltage Vin by 10 times, although the voltage Vin of the signal ain is in any range of the first range, the second range, the third range, and the fourth range.

Actually, transition of the voltage Vin of the signal ain is made as illustrated in FIG. 17. In detail, the voltage Vin is in the third range before timing t1, in the second range during a period from the timing t1 to timing t2, in the first range during a period from the timing t2 to timing t3, in the second range during a period from the timing t3 to timing t4, in the third range during a period from the timing t4 to timing t5, in the fourth range during a period from the timing t5 to timing t6, and in the third range during a period after timing t5.

In this way, in the course of transition of the voltage Vin, for example, when the voltage Vin decreases at the timing t1 to be shifted from the third range to the second range, the enabled gate selector is switched from 270*c* to 270*b*, and thereby, a transistor which performs a switching operation is also switched from 232*c* to 232*b*. Accordingly, the voltage Out can continuously change from the third range higher than or equal to the voltage $V_B$ and lower than the voltage $V_C$ to the second range higher than or equal to the voltage $V_A$ and lower than the voltage $V_B$.

Here, a case where the voltage Vin decreases to be changed from the third range to the second range is described as an example, but the same is applied to other cases, for example, if a change from the second range to the first range is made, a gate selector which is enabled is switched from 270*b* to 270*a* and a transistor which performs a switching operation is switched from 232*b* to 232*a*. Accordingly, the voltage Out can continuously change from the second range higher than or equal to the voltage $V_A$ and lower than the voltage $V_B$ to the first range higher than or equal to 0 V and lower than the voltage $V_A$.

In addition, in case where the voltage Vin increases to be changed, for example, from the first range to the second range, the gate selector which is enabled is switched from 270*a* to 270*b*, and the transistor which performs a switching operation is switched from 231*a* to 231*b*. Accordingly, the voltage Out can continuously change from the first range to the second range.

There are four pairs of transistors in the drive circuit (third circuit), but when the voltage Vin changes, the transistor which performs the switching operation is one of the high side or low side of one pair of transistors, and the other transistor are turned off. In addition, if the voltage Vin is constant, all the transistors in the four pairs of transistors are turned off. Accordingly, it is possible to achieve low power consumption.

In addition, according to the drive circuit (third circuit), the differential amplifier 221 and the selector 223 operate by using relatively low voltages ($V_A$ and Gnd) as a power supply, and thus, it is possible to prevent a size of the device from increasing and the like.

Figure 18:
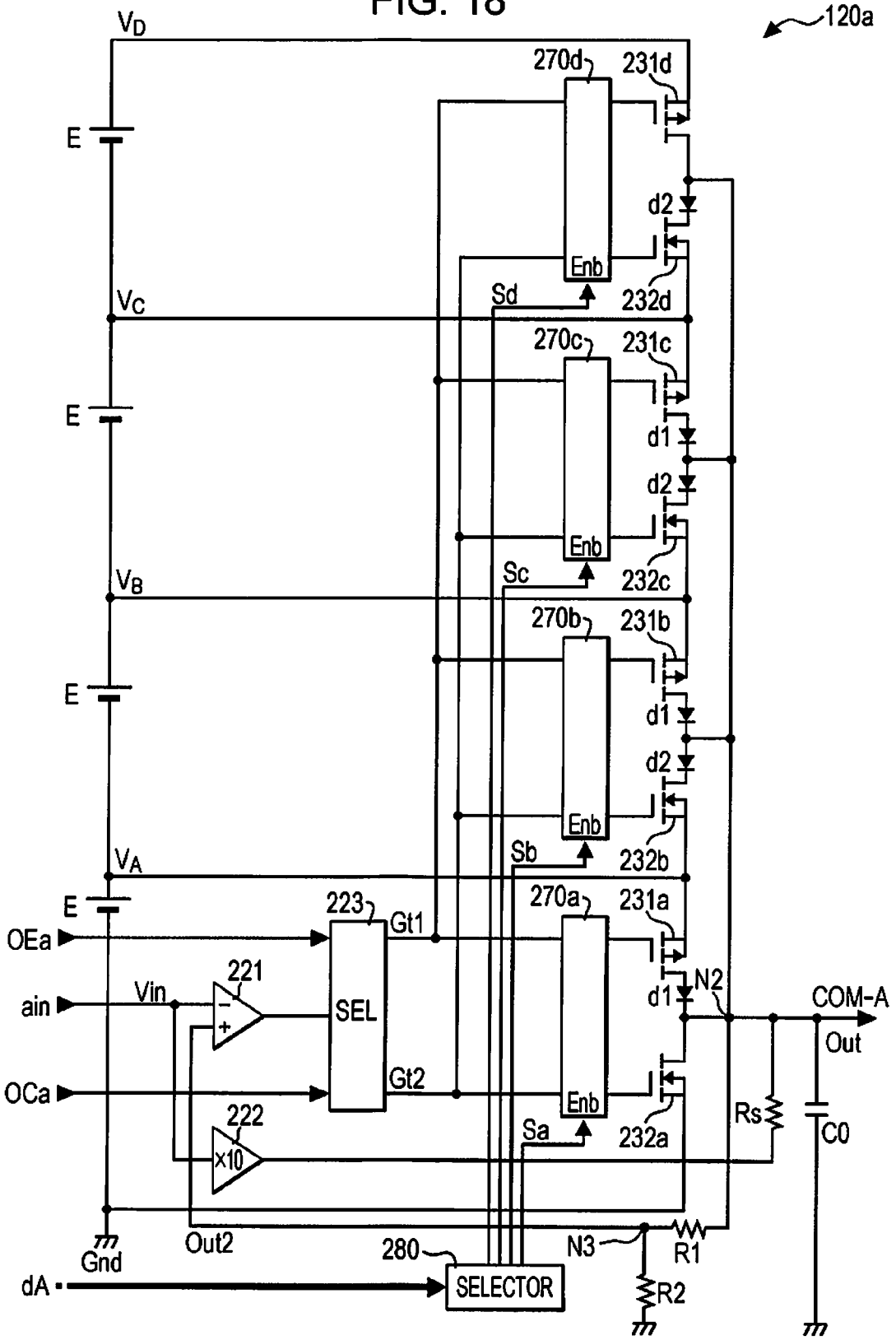
FIG. 18 is a diagram illustrating a drive circuit (fourth circuit) which can be applied to the printing apparatus (second apparatus).

FIG. 18 is a diagram illustrating a configuration of a drive circuit (fourth circuit).

As illustrated in FIG. 18, the drive circuit (fourth circuit) includes a resistance element Rs instead of the switch 293 in the drive circuit (third circuit). Accordingly, a relationship between the drive circuit (third circuit) and the drive circuit (fourth circuit) is the same as the relationship between the drive circuit (first circuit) and the drive circuit (second circuit).

The drive circuit (third circuit) and the drive circuit (fourth circuit) are described by using the drive circuit 120*a* which outputs the drive signal COM-A as an example, and a configuration of the drive circuit 120*b* which outputs the drive signal COM-B is the same as the configuration of the drive circuit 120*a* except for input and output signals. That is, the drive circuit 120*b* in the drive circuit (third circuit) and the drive circuit (fourth circuit) has a configuration in which a signal OEb is input instead of the signal OEa, a signal OCb is input instead of the signal OCa, a signal Bin is input instead of the signal Ain, data dB is input instead of the data dA, while a drive signal COM-B is output from the node N2.

If the differential amplifier 221 and the selector 223 in the drive circuit (third circuit) of FIG. 15 are allowed to operate at a relatively high voltage, the following drive circuit (fifth circuit) may be used.

Figure 19:
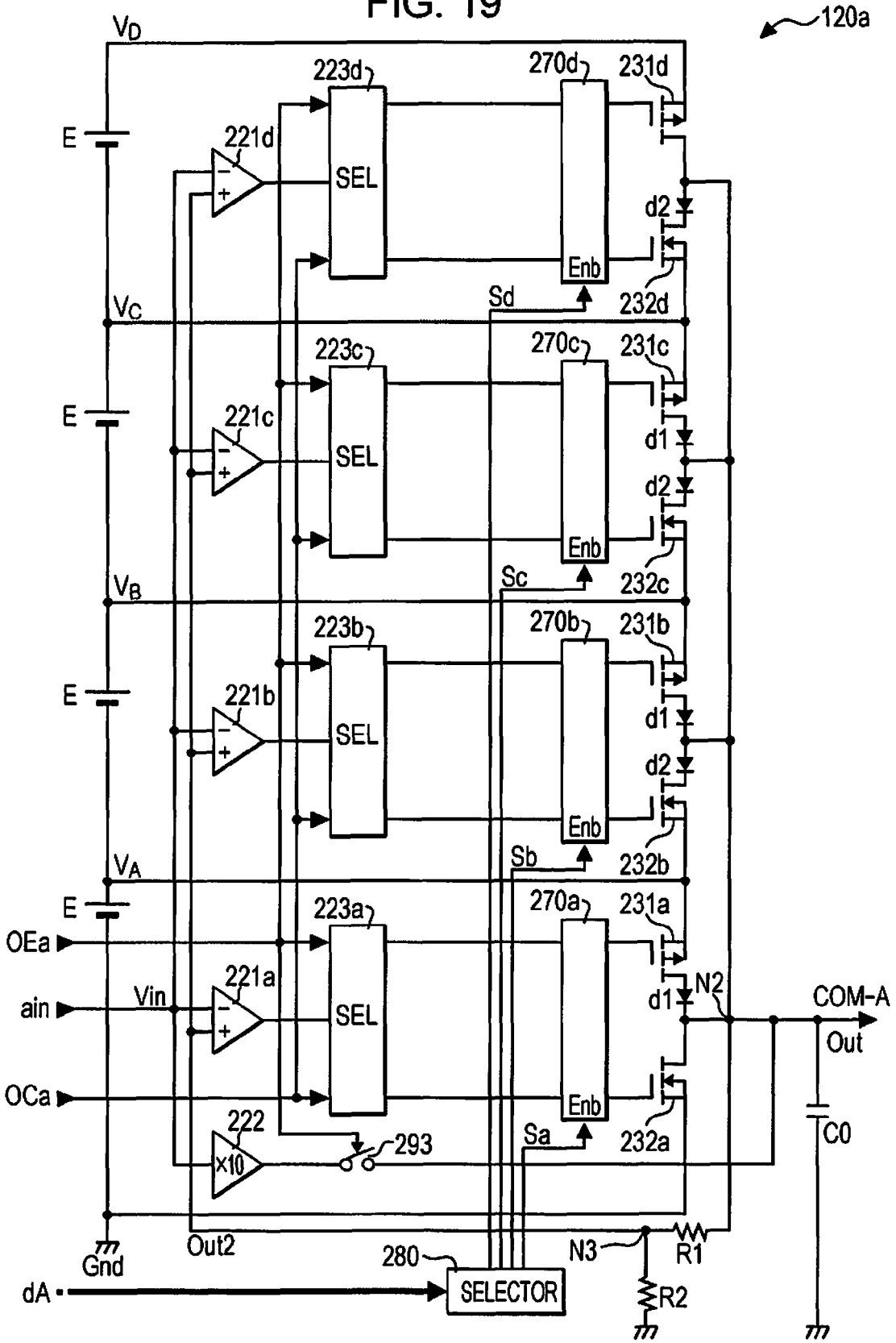
FIG. 19 is a diagram illustrating a drive circuit (fifth circuit) which can be applied to the printing apparatus (second apparatus).

FIG. 19 is a diagram illustrating a configuration of the drive circuit (fifth circuit). The drive circuit (fifth circuit) illustrated in FIG. 19 is mainly different from the drive circuit (third circuit) illustrated in FIG. 15 in that a set of a differential amplifier and a selector is provided in correspondence with each of the pairs of transistors.

This point will be described in detail. A differential amplifier 221*a* and a selector 223*a* corresponding to the pair of transistors 231*a* and 232*a* are provided, a differential amplifier 221*b* and a selector 223*b* corresponding to the pair of transistors 231*b* and 232*b* are provided, a differential amplifier 221*c* and a selector 223*c* corresponding to the pair of transistors 231*c* and 232*c* are provided, and a differential amplifier 221*d* and a selector 223*d* corresponding to the pair of transistors 231*d* and 232*d* are provided.

Each of the differential amplifiers 221*a*, 221*b*, 221*c*, and 222*d* is the same as the differential amplifier 221 in FIG. 15, and amplifies a differential voltage obtained by subtracting the voltage Vin of the input signal ain which is an input signal from the voltage Out2 and outputs the differential voltage.

Each of the selectors 223*a*, 223*b*, 223*c*, and 223*d* is the same as the selector 223 in FIG. 15. Accordingly, when the output signal of the differential amplifier 221 is selected, the output voltage of each of the selectors 223*a*, 223*b*, 223*c*, and 223*d* is in a range from the ground Gnd to the voltage $V_A$, an H level becomes the voltage $V_A$, and an L level becomes the ground Gnd.

Each of the gate selectors 270*a*, 270*b*, 270*c*, and 270*d* is the same as the gate selector in the drive circuit (third circuit) in FIG. 15.

According to the drive circuit (fifth circuit), a size of an element is prevented from increasing, low power consumption is achieved, and the voltage Out obtained by amplifying the voltage Vin of the signal ain by 10 times can be output as the drive signal COM-A, in the same manner as the drive circuit (third circuit).

Figure 20:
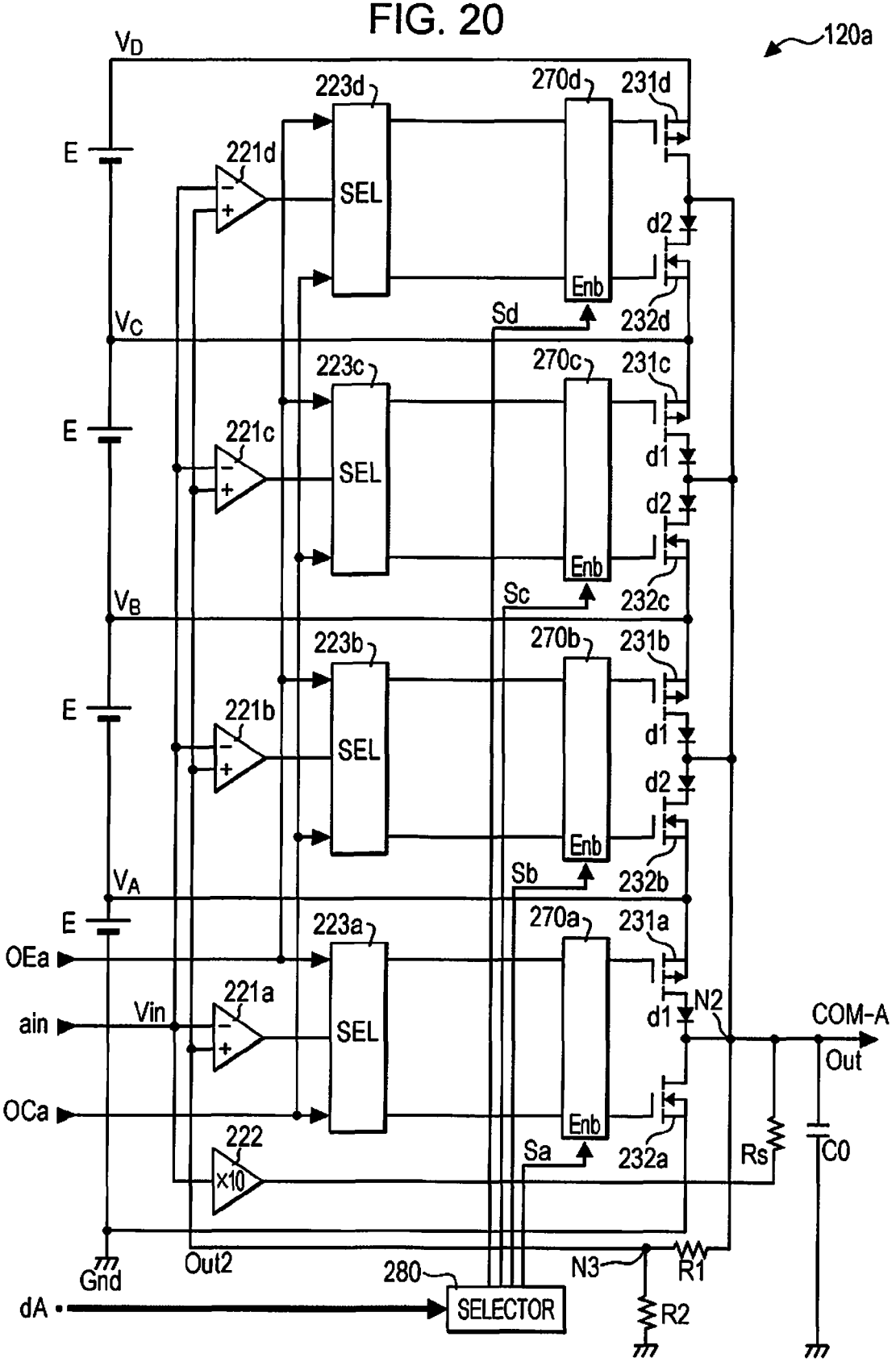
FIG. 20 is a diagram illustrating a drive circuit (sixth circuit) which can be applied to the printing apparatus (second apparatus).

FIG. 20 is a diagram illustrating a configuration of a drive circuit (sixth circuit).

As illustrated in FIG. 20, the drive circuit (sixth circuit) includes a resistance element Rs provided instead of the switch 293 of the drive circuit (fifth circuit). Accordingly, a relationship between the drive circuit (fifth circuit) and the drive circuit (sixth circuit) is the same as the relationship between the drive circuit (first circuit) and the drive circuit (second circuit), and the relationship between the drive circuit (third circuit) and the drive circuit (fourth circuit).

The drive circuit (fifth circuit) and the drive circuit (sixth circuit) are described by using the drive circuit 120*a* which outputs the drive signal COM-A as an example, and a configuration of the drive circuit 120*b* which outputs the drive signal COM-B is the same as the configuration of the drive circuit 120*a* except for input and output signals.

Figure 21:
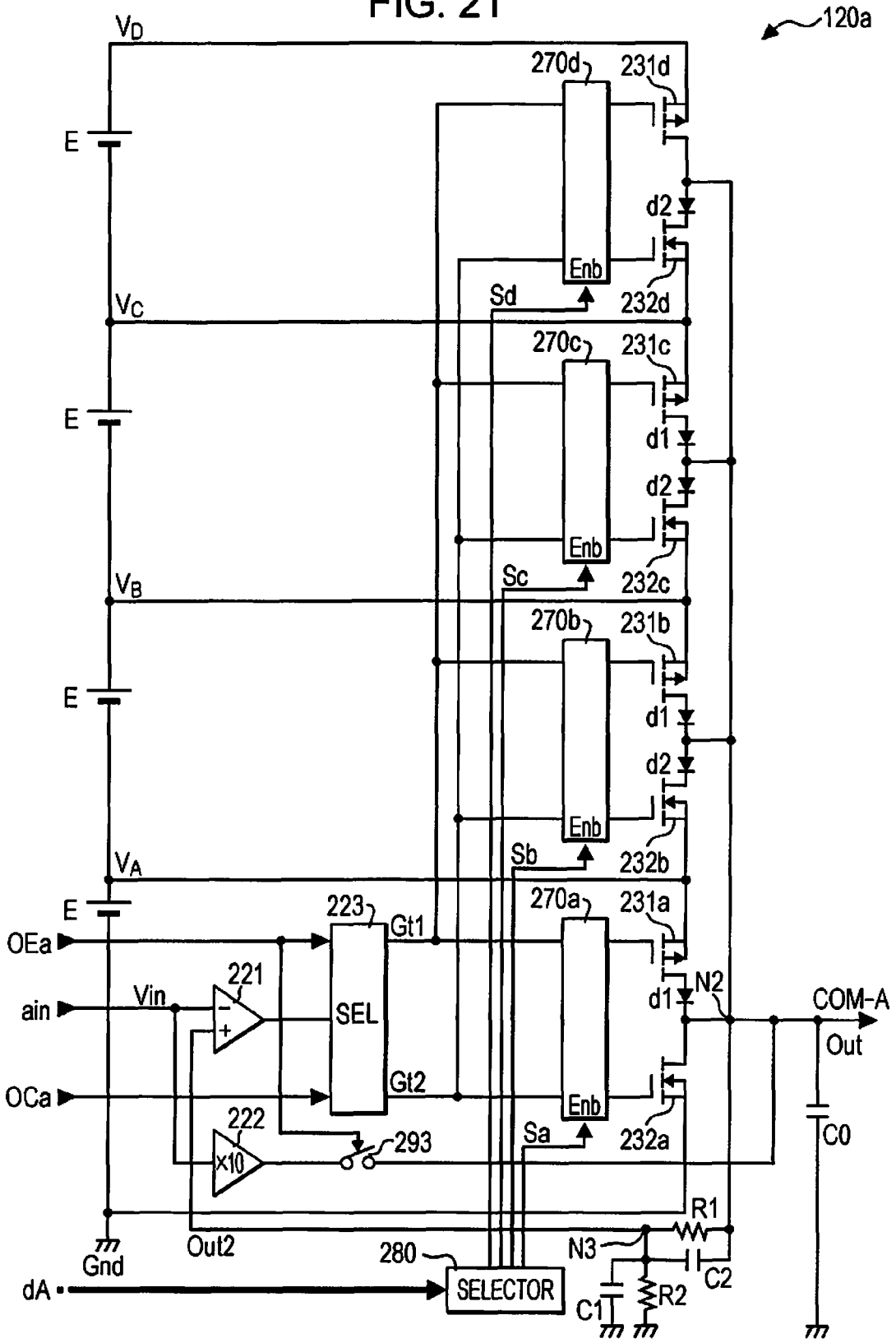
FIG. 21 is a diagram illustrating an application example of the drive circuit (third circuit).

However, each of the differential amplifiers 221 (221*a* to 221*d*) and the selectors 223 (223*a* to 223*d*) in the drive circuit (third circuit) illustrated in FIG. 15, the drive circuit (fourth circuit) illustrated in FIG. 18, the drive circuit (fifth circuit) illustrated in FIG. 20, and the drive circuit (sixth circuit) illustrated in FIG. 21 can use relatively low voltage as a power supply. Accordingly, breakdown voltages of the transistors and the like configuring the differential amplifier 221 or the selector 223 can also be designed to be low in accordance with the power supply with a low amplitude.

Meanwhile, the voltage Out of the node N2 is approximately 40 V with a maximum amplitude. Accordingly, it is not possible to directly return the voltage Out with a high amplitude to the differential amplifier 221 having a low breakdown voltage.

Hence, each of the drive circuits (third circuit, fourth circuit, fifth circuit, and sixth circuit) has a configuration in which the voltage Out is divided by the resistance elements R1 and R2 and the divided voltage Out2 is fed back to the differential amplifier 221.

The circuit configuration of the differential amplifier 221 is well known, and, in short, is a configuration in which an input terminal (+) is coupled to a gate of one of the transistors which are configuration elements. Accordingly, since considerable capacitance components are parasitic on the input terminal (+), a CR filter is formed by the parasitic capacitance components and the resistance element R1, and a primary delay occurs in a feedback path. The delay causes a switching frequency of a pair of transistors to be lowered as time elapses, and thereby, a problem occurs in which waveform reproducibility of the drive signal COM-A (COM-B) deteriorates.

Hence, next, a technology to solve the problem will be described.

FIG. 21 is a diagram illustrating a configuration obtained by improving the drive circuit (third circuit). As illustrated in FIG. 21, a capacitor C1 is coupled in parallel to a resistance element R2, a capacitor C2 is coupled in parallel to a resistance element R1, and thereby, a differential and integral circuit is configured. Thereby, a phase delay of the feedback path is compensated by the differential and integral circuit which uses the resistance elements R1 and R2 for voltage division and includes the capacitors C1 and C2, and thus, the waveform reproducibility of the drive signal COM-A is prevented from deteriorating.

A point in which the capacitors C1 and C2 are provided is not limited to the drive circuit (third circuit), and can be applied to the drive circuit (fourth circuit), the drive circuit (fifth circuit), and the drive circuit (sixth circuit).

Each of the drive circuits (third circuit, fourth circuit, fifth circuit, and sixth circuit) has the configuration in which the selector 280 discriminates whether or not the voltage Vin is included in any one range from the first range to the fourth range in accordance with the data dA (dB) whose analog conversion is not performed, but the discrimination may be made by the signal ain (bin) whose analog conversion is completed although there are some accuracy and delay occur. In addition, the discrimination may be made by weighting the data dA (dB) and the signal ain (bin) whose analog conversion is completed.

Accordingly, in case of selecting a pair of transistors in response to a signal based on an original drive signal, there may also be a case where the signal is the data dA (dB), there may also be a case where the signal is the signal ain (bin) obtained by performing analog conversion of the data dA (dB), or there may also be a case where the signal is obtained by weighting the data dA (dB) and the signal ain (bin).

Since the selector 280 enables one of the gate selectors 270*a*, 270*b*, 270*c*, and 270*d* in response to the signal based on the original drive signal, and a pair of transistors corresponding to the enabled gate selector among the four pairs of transistors is used for the switching operation, the selector 280 and the gate selectors 270*a*, 270*b*, 270*c*, and 270*d* can be conceptualized as a transistor pair switching unit.

The number of sets of the pairs of transistors is "4" in the drive circuits (third circuit, fourth circuit, fifth circuit, and sixth circuit), but the number may be "2" or more. As the number of sets increases, a voltage of each reference power supply E can be decreased.

In addition, since each of the drive circuits (third circuit, fourth circuit, fifth circuit, and sixth circuit) has a configuration in which the voltages $V_A$, $V_B$, $V_C$, and $V_D$ are output by four-stage series coupling (FIG. 15, FIG. 18, FIG. 19, and FIG. 20) of the reference power supply which outputs the voltage E, a difference between the high side voltage and the low side voltage in each voltage set is set to be the voltage E (=10.5 V), but a configuration in which the difference is not set may be provided.

Regarding the voltage range, adjacent ranges among the first range to the fourth range may partially overlap each other.

Hence, the drive circuit (third circuit, fourth circuit, fifth circuit, and sixth circuit) has a configuration in which one of the four pairs of transistors is selected in accordance with the data dA (dB) or the like, but a configuration can also be used in which a power supply voltage is switched by one pair of transistors in accordance with the data dA (dB) or the like, as will be described in the following drive circuit (seventh circuit).

Figure 22:
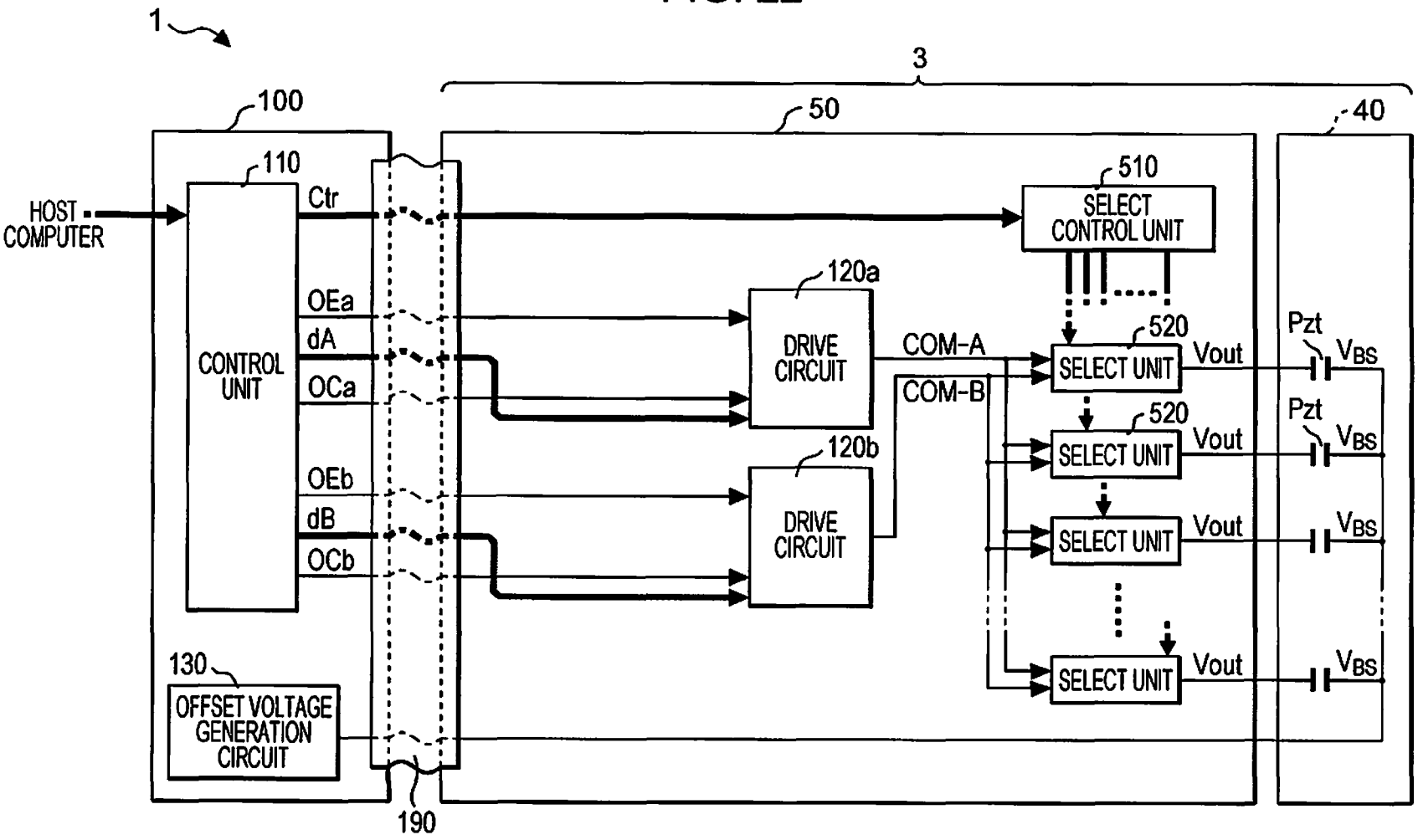
FIG. 22 is a block diagram illustrating an electrical configuration of a printing apparatus (third apparatus).

FIG. 22 is a block diagram illustrating an electrical configuration of a printing apparatus (third apparatus) including the drive circuit (seventh circuit).

The printing apparatus (third apparatus) illustrated in FIG. 22 does not include DACs 113*a* and 113*b* and voltage amplifiers 115*a* and 115*b* as compared with the printing apparatus (first apparatus) illustrated in FIG. 5, but the DAC 113*a* and the voltage amplifier 115*a* are moved to a side of the drive circuit 120*a*, when viewed on a side where the drive signal COM-A is output.

Figure 23:
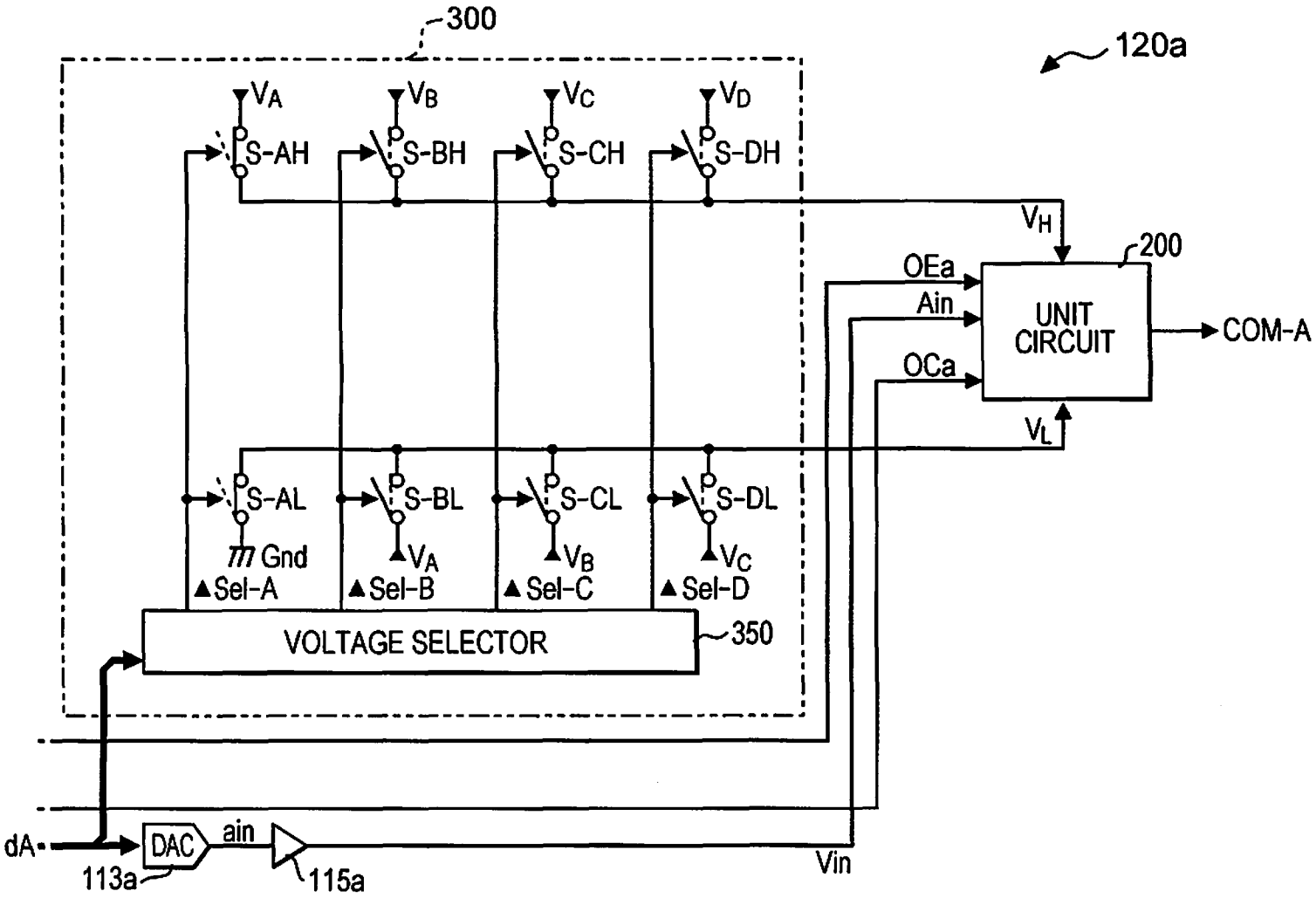
FIG. 23 is a diagram illustrating a drive circuit (seventh circuit) applied to the printing apparatus (third apparatus).

FIG. 23 is a diagram illustrating a configuration of the drive circuit (seventh circuit). As illustrated in FIG. 23, the drive circuit (seventh circuit) that outputs the drive signal COM-A includes a unit circuit 200, the DAC 113*a*, the voltage amplifier 115*a*, and a voltage switch 300.

Among these, the DAC 113*a* converts the digital data dA into analog signal ain with a small amplitude, and the voltage amplifier 115*a* amplifies a voltage of the signal ain by, for example, 10 times to output as a signal Ain with a large amplitude.

The voltage switch (power supply voltage switching unit) 300 selects one of the sets of voltages ($V_A$, Gnd), ($V_B$, $V_A$), ($V_C$, $V_B$), and ($V_D$, $V_C$) in accordance with the data dA, and supplies the selected set of voltages as power supply voltages ($V_H$, $V_L$) of the unit circuit 200.

In detail, the voltage switch 300 includes a voltage selector 350, a set of switches S-AH and S-AL, a set of switches S-BH and S-BL, a set of switches S-CH and S-CL, and a set of switches S-DH and S-DL, and the voltage selector 350 outputs select signals Sel-A, Sel-B, Sel-C, and Sel-D in accordance with the data dA as follows.

In detail, in case where a voltage of the signal Ain obtained by voltage-amplifying the data dA whose analog conversion is performed is in the first range, the voltage selector 350 sets the select signal Sel-A to an H level and sets the select signals Sel-B, Sel-C, and Sel-D to an L level. In addition, in case where the voltage of the signal Ain obtained by voltage-amplifying the data dA whose analog conversion is performed is in the second range, the voltage selector 350 sets the select signal Sel-B to an H level and sets the select signal Sel-A, Set-C, and Sel-D to an L level. In case where the voltage of the signal Ain is in the third range, the voltage selector 350 sets the select signal Sel-C to an H level and sets the select signal Sel-A, Sel-B, and Sel-D to an L level. In case where the voltage of the signal Ain is in the fourth range, the voltage selector 350 sets the select signal Sel-D to an H level and sets the select signal Sel-A, Sel-B, and Sel-C to an L level.

The switches S-AH and S-AL are turned on when the select signal Sel-A is at an H level, the voltage $V_A$ is applied to one terminal of the switch S-AH, and one terminal of the switch S-AL is coupled to the ground Gnd of zero volt. The switches S-BH and S-BL are turned on when the select signal Sel-B is at an H level, the voltage $V_B$ is applied to one terminal of the switch S-BH, and the voltage $V_A$ is applied to one terminal of the switch S-BL. The switches S-CH and S-CL are turned on when the select signal Sel-C is at an H level, the voltage $V_C$ is applied to one terminal of the switch S-CH, and the voltage $V_B$ is applied to one terminal of the switch S-BL. The switches S-DH and S-DL are turned on when the select signal Sel-D is at an H level, the voltage $V_D$ is applied to one terminal of the switch S-DH, and the voltage $V_C$ is applied to one terminal of the switch S-DL.

The other terminals of the switches S-AH, S-BH, S-CH, and S-DH are commonly coupled, and a voltage selected by turning on one of the switches is supplied to the unit circuit 200 as the high side voltage $V_H$ of the power supply. In the same manner, the other terminals of the switches S-AL, S-BL, S-CL, and S-DL are commonly coupled, and a voltage selected by turning on one of the switches is supplied to the unit circuit 200 as the low side voltage $V_L$ of the power supply.

Hence, the power supply voltages ($V_H$, $V_L$) of the unit circuit 200 are as follows in accordance with the voltage of the signal Ain. That is, the power supply voltages ($V_H$, $V_L$) become a set of voltages ($V_A$, Gnd) in case where the voltage of the signal Ain is in the first range, become a set of voltages ($V_B$, $V_A$) in case of the second range, become a set of voltages ($V_C$, $V_B$) in case of the third range, and become a set of voltages ($V_D$, $V_C$) in case of the fourth range.

The unit circuit 200 increases drive capability of the signal Ain by using the signals OEa and OCa and outputs the signal as the drive signal COM-A.

Figure 24:
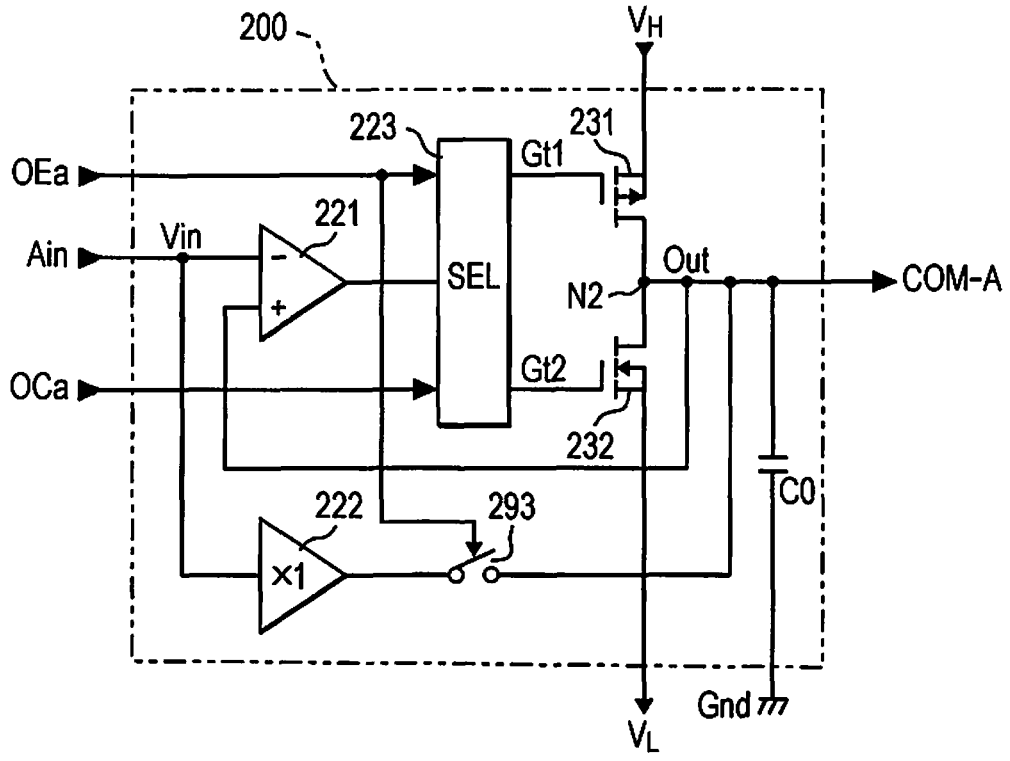
FIG. 24 is a diagram illustrating a unit circuit (first circuit) in the drive circuit (third circuit).

FIG. 24 is a diagram illustrating a configuration of an example of the unit circuit 200 in the drive circuit (seventh circuit). The unit circuit 200 illustrated in FIG. 24 is substantially the same as the drive circuit (first circuit) illustrated in FIG. 11, except that the high side voltage $V_H$ is applied to the source terminal of the transistor 231 and the low side voltage $V_L$ is applied to the source terminal of the transistor 232.

That is, the power supply voltage of a pair of transistors is only different, and it is the same as each other in that the voltage Out of the node N2 is controlled to follow the voltage Vin of the signal Ain in a range of the power supply voltage.

Since the unit circuit 200 also has several aspects, there is a case where the unit circuit 200 illustrated in FIG. 24 is denoted by a unit circuit (first circuit) and the other unit circuits are denoted by attaching parentheses including words such that the other unit circuits are referred to as a unit circuit (second circuit) so as to distinguish from each other.

Here, in case where the voltage Vin is higher than or equal to the current voltage $V_H$, the voltage is switched to a set higher by one stage as the voltages $V_H$ and $V_L$, while in case where the voltage Vin is lower than the voltage $V_L$, the voltage is switched to a set lower by one stage as the voltages $V_H$ and $V_L$. Accordingly, according to the drive circuit (seventh circuit), in case where the voltage Vin of the signal Ain in a range from the ground Gnd to the voltage $V_D$, the voltage switch 300 switches the set of voltages $V_H$ and $V_L$ according to the voltage Vin, while the unit circuit 200 controls the voltage Out of the node N2 so as to follow the voltage Vin.

Since the voltage Out of the drive signal COM-A swings in the range of 0 to 40 V, the power supply voltage of the unit circuit is also required to be approximately 40 V if the set of voltages is not switched, which leads to a high cost and an increase of a scale of the circuit.

In contrast to this, according to the drive circuit (seventh circuit), the set of voltages is switched in accordance with the data dA (voltage Vin), and is supplied as the power supply voltages of the unit circuit 200. Accordingly, in the present embodiment, although the voltage Out of approximately 0 to 40 V is output, the power supply voltage of the unit circuit 200 is suppressed to 10.5 V, and thus, it is possible to prevent the cost from increasing and to prevent the scale of the circuit from increasing.

Figure 25:
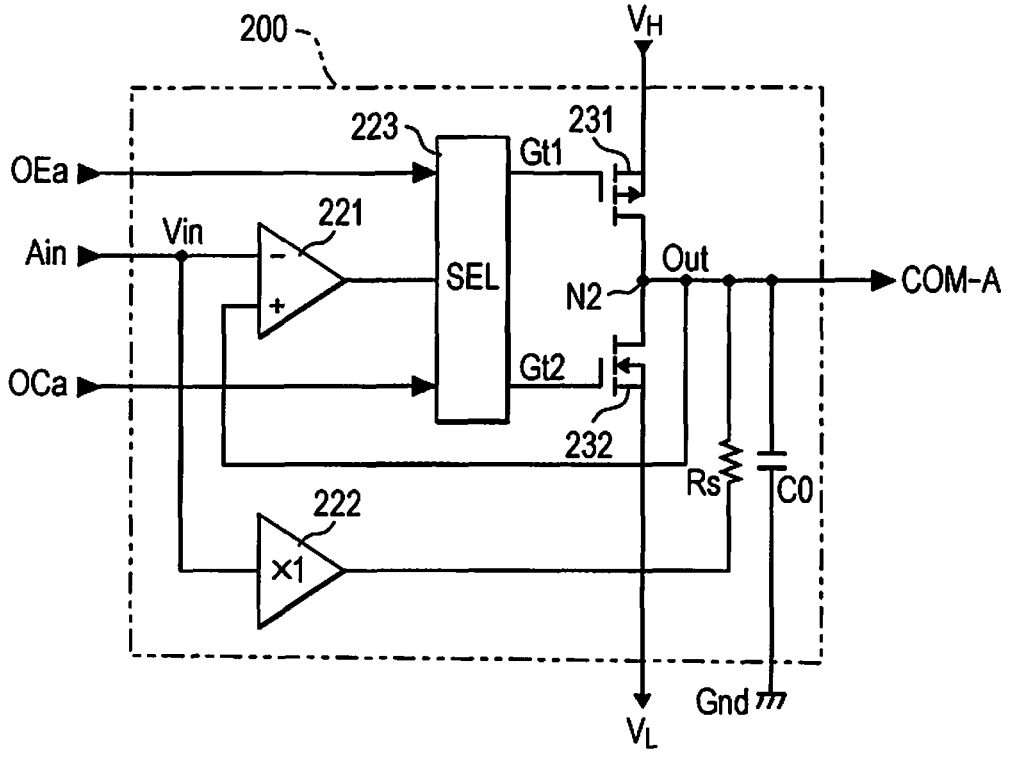
FIG. 25 is a diagram illustrating a unit circuit (second circuit) which can be applied to the drive circuit (third circuit).

FIG. 25 is a diagram illustrating another unit circuit (second circuit) which can be applied to the drive circuit (seventh circuit) illustrated in FIG. 22.

The unit circuit (second circuit) illustrated in FIG. 25 includes a resistance element Rs instead of the switch 293 in the unit circuit (first circuit) illustrated in FIG. 24.

Accordingly, a relationship between the unit circuit (first circuit) and the unit circuit (second circuit) is the same as the relationship between the drive circuit (first circuit) and the drive circuit (second circuit), or the relationship between the drive circuit (third circuit) and the drive circuit (fourth circuit).

The drive circuit (seventh circuit) is described by using the drive circuit 120*a* that outputs the drive signal COM-A as an example, and a configuration of the drive circuit 120*b* that outputs the drive signal COM-B is the same as the configuration of the drive circuit 120*a* except for input and output signals.

Figure 26:
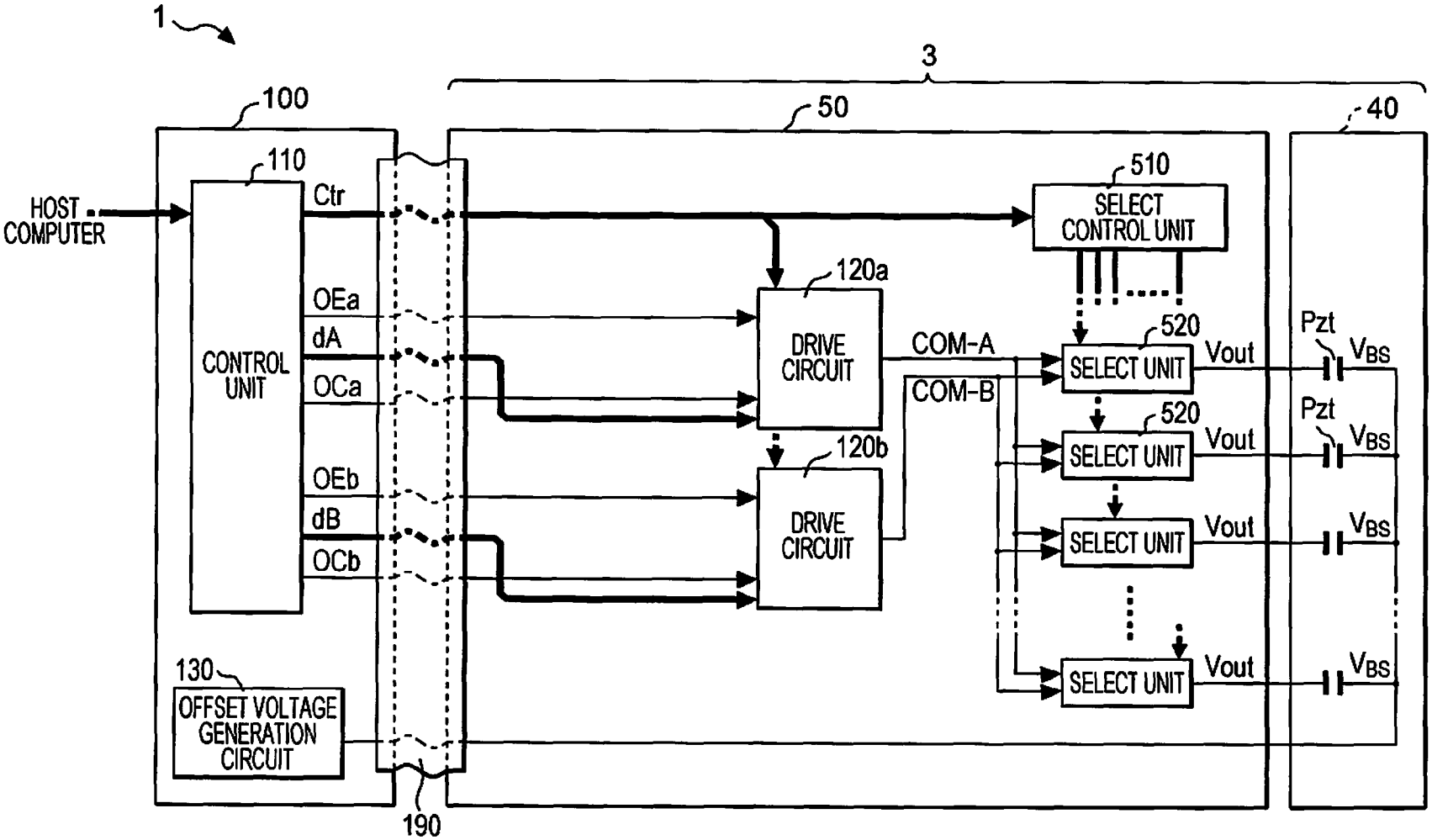
FIG. 26 is a block diagram illustrating an electrical configuration of a printing apparatus (fourth apparatus).

FIG. 26 is a block diagram illustrating an electrical configuration of a printing apparatus (fourth apparatus). The printing apparatus (fourth apparatus) illustrated in FIG. 26 is different from the printing apparatus (third apparatus) illustrated in FIG. 22 in that the print data SI which is a part of the control signal Ctr is supplied to each of the drive circuits 120*a* and 120*b*.

Figure 27:
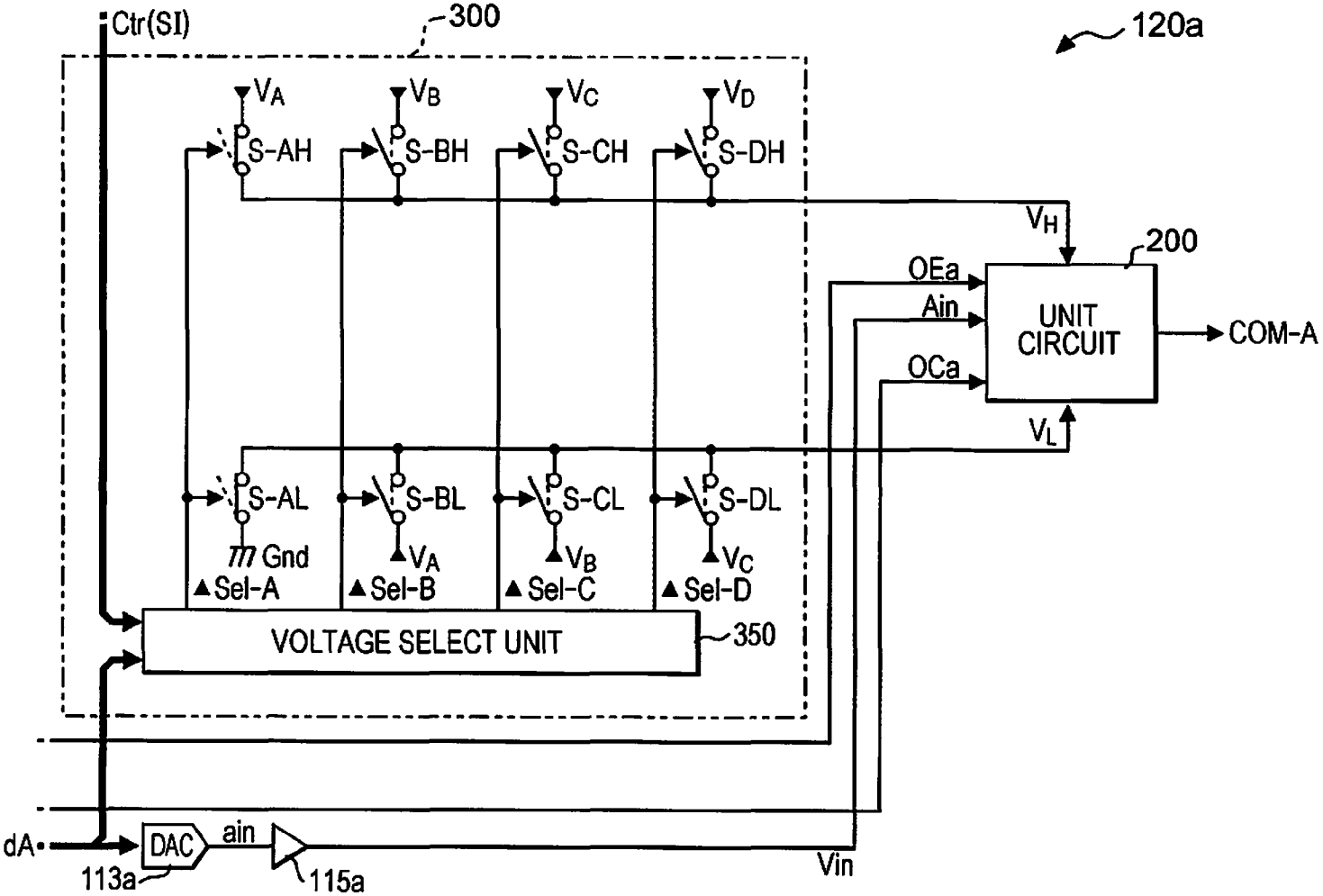
FIG. 27 is a diagram illustrating a drive circuit (eighth circuit) applied to the printing apparatus (fourth apparatus).

FIG. 27 is a diagram illustrating a configuration of a drive circuit (eighth circuit) applied to the printing apparatus (fourth apparatus). The drive circuit (eighth circuit) illustrated in FIG. 27 is mainly different from the drive circuit (seventh circuit) illustrated in FIG. 23 in that the print data SI is supplied to the voltage selector 350 in the voltage switch 300.

This point will be described in detail. A point in which the voltage selector 350 in the drive circuit (eighth circuit) outputs any one of the select signals Sel-A, Sel-B, Sel-C, and Sel-D at an H level in accordance with the data dA (voltage Out) is the same as in the drive circuit (seventh circuit), but a size of the capacitance load is estimated from the print data SI and the select signals Sel-A, Sel-B, Sel-C, and Sel-D are switched by the amount of delay according to a magnitude of the estimated capacitance load.

Estimation performed by the voltage selector 350 is, for example, as follows.

That is, the voltage selector 350 latches the print data SI included in the control signal Ctr from the control unit 110 by a circuit which is the same as the shift register 512 and the latch circuit 514 in the select control unit 510 (refer to FIG. 7), analyzes the latched print data SI, and estimates the magnitude of the capacitance load by obtaining the number of piezoelectric elements Pzt to one terminal of which the drive signal COM-A is applied during each of the periods T1 and T2 of the print cycle Ta.

In addition, here, the amount of delay indicates a delay time at timing of switching a logic level of the select signal.

In the drive circuit 120*a* that outputs the drive signal COM-A, for example, in case where large or medium dots are formed by all the nozzles in the head unit 3 during the period T1 of the print cycle Ta, the drive signal COM-A is applied to one terminal of each of all the piezoelectric elements Pzt, and thereby, a load is maximized, while, in case where small dots are formed or not recorded in all the nozzles, the drive signal COM-A is not selected, and thereby, the load is minimized (zero). The same is applied to the drive circuit 120*b* that outputs the drive signal COM-B.

That is, the capacitance load in the drive circuit 120*a* (120*b*) largely varies depending on the print contents defined by the print data SI.

Since a path from the node N2 to one terminal of the piezoelectric element Pzt includes the transfer gates 524*a* and 524*b* (refer to FIG. 8) of the select unit 520, there are inductance components, resistance components, and the like.

Accordingly, a waveform of the drive signal COM-A (COM-B) finally applied to one terminal of the piezoelectric element Pzt is blunted by an integral circuit formed by capacitance of the piezoelectric element Pzt, the inductance components, the resistance components, and the like. The extent of blunting of the waveform becomes severe (becomes larger) as the number of piezoelectric elements Pzt which is selected increases, that is, as the capacitance load becomes larger, and the drive signal applied to one terminal of the piezoelectric element Pzt is delayed with respect to the signal Ain (Bin).

Accordingly, in a configuration in which a delay of the drive signal COM-A (COM-B) is not assumed, a target voltage of the drive signal COM-A (COM-B) does not match the set of voltages selected by the voltage switch 300, and possibility of distorting the waveform increases.

The voltage selector 350 in the drive circuit (eighth circuit) increases the amount of delay of the select signals Sel-A, Sel-B, Sel-C and Sel-D as the capacitance estimated from the print data SI included in the control signal Ctr increases. Accordingly, since the set of voltages is switched in accordance with the delay of the drive signal COM-A (COM-B), the mismatch is corrected, and as a result, it is possible to prevent the waveform from being distorted.

The switching delay is described by using a case where the set of voltages is switched as an example, and but can also be applied to the drive circuits (third circuit, fourth circuit, fifth circuit, and sixth circuit) which switch the pairs of transistors. In case of being applied to the drive circuit (third circuit, fourth circuit, fifth circuit, and sixth circuit), while being not illustrated in particular, for example, a configuration may be provided in which print data SI is supplied to the selector 280, the selector 280 estimates a magnitude of the capacitance load from the print data SI, and timing when the enabled gate selector is switched is delayed.

The number of sets of power supply voltages in the drive circuit (seventh circuit and eighth circuit) is set to "4", but may be set to "2" or more. In addition, the drive circuit (seventh circuit and eighth circuit) may have a configuration in which the power supply voltages of each set is uneven, the adjacent ranges of the voltage ranges partially overlap each other, or the voltage selector 350 is discriminated by the signal ain (bin) whose analog conversion is completed, not by the data dA (dB).

In the above description, the transistor 231 of the pair of transistors is a P-channel type transistor and the transistor 232 of the pair of transistors is an N-channel type transistor, but the transistors 231 and 232 may be P-channel type transistors or an N-channel type transistors. However, it is necessary to transfer as it is or inversely transfer the output signal of the differential amplifier 221 depending on the channel type of the transistor, or to appropriately adjust a logic level of the gate signal when the transistor is forcibly turned off.

In addition, the drive circuit (first circuit and second circuit) and the unit circuit (first circuit and second circuit) may include a diode for blocking a current flowing from the node N2 to the drain terminal of the transistor 231, and a diode for blocking a current flowing from the drain terminal of the transistor 232 to the node N2.

Since a target which is driven by the drive circuit is a capacitor such as the piezoelectric element Pzt, although the node N2 enters a high impedance state after the voltage Out becomes constant, the voltage Out is held constant. Accordingly, a period in which the linear amplifier 222 supplies the output signal toward the node N2 through the switch 293 (variable resistor) or the resistance element Rs need not be an entire region of a period in which the signal OEa (OEb) is at an H level, that is, an entire region of a period in which both the transistors 231 and 232 are turned off, and may be a part of the period. For example, the period in which the linear amplifier 222 supplies the output signal toward the node N2 may be limited to the first half in time among the period in which the signal OEa (OEb) is at an H level. In this configuration, the voltage Out of the node N2 is held in the voltage of the linear amplifier 220, which is output during the first half of the period, during a second half of the period.

In addition, accuracy of a waveform of the drive signal which is output is somewhat deteriorated during a period in which the linear amplifier 220 supplies the output signal toward the node N2, but timing when the signal OEa changes from an L level to an H level may not be included.

In the above description, the linear amplifier 222 operates all the times, but a period in which the output signal of the linear amplifier 222 is required is a period in which the switch 293 is turned on or a period in which a voltage change of the signal Ain (Bin) is less than or equal to a threshold. Accordingly, it is unnecessary for the linear amplifier 222 to operate during a period other than the period, specifically, during a period in which the signal OEa (OEb) is at an L level. Hence, for example, during a period in which the signal OEa (OEb) is at an L level, the power supply of the linear amplifier 222 may be cut off to stop an operation of the linear amplifier 222.

The liquid ejecting apparatus is described as a printing apparatus in the above description, but may be a three-dimensional shaping apparatus which ejects liquid to form a three-dimensional object, a textile printing apparatus which ejects liquid to dye a fabric, or the like.

In addition, each of the drive circuits 120*a* and 120*b* is configured to be mounted on the head unit 3, but they may be configured to be mounted on the main substrate 100.

However, the configuration in which the drive circuits 120*a* and 120*b* are mounted on the main substrate 100 does not require to supply a signal with a large amplitude to the head unit 3 through the long flexible flat cable 190, and thus, it is disadvantageous in terms of power consumption and noise resistance. In other words, it is not necessary to supply a signal with a large amplitude to the flexible flat cable 190, in the configuration in which the drive circuits 120*a* and 120*b* are mounted on the head unit 3, and thus, it is advantageous in terms of power consumption and noise resistance.

Furthermore, in the above description, an example is described in which the piezoelectric element Pzt for ejecting ink is used as a drive target of the drive circuits 120*a* and 120*b*, but when considering separating the drive circuits 120*a* and 120*b* from the printing apparatus, the drive target is not limited to the piezoelectric element Pzt, and can be applied to all of loads with capacitive components, such as an ultrasonic motor, a touch panel, an electrostatic speaker, and a liquid crystal panel.

What is claimed is:

1. A liquid ejecting apparatus comprising:

an ejecting unit that includes a piezoelectric element which is driven based on a drive signal that is output from a predetermined output terminal, and ejects liquid by driving the piezoelectric element;

an amplification unit that amplifies an original drive signal which is an origin of the drive signal and outputs the amplified signal toward the output terminal; and a voltage output unit that outputs a voltage responding to the original drive signal toward the output terminal during a predetermined period of a part or all of a period in which a magnitude of a voltage change of the original drive signal is less than or equal to a threshold.

2. The liquid ejecting apparatus according to claim 1, wherein the voltage output unit includes a linear amplifier that amplifies a voltage of the original drive signal by a predetermined multiple, and a variable resistor that is provided between the linear amplifier and the output terminal and has a resistance value which is set during the predetermined period is smaller than a resistance value which is set during a period other than the predetermined period.

3. The liquid ejecting apparatus according to claim 2, wherein the variable resistor is a switch that is turned on during the predetermined period.

4. The liquid ejecting apparatus according to claim 1, wherein the amplification unit includes a differential amplifier that outputs a differential signal which is obtained by amplifying a differential voltage between the original drive signal and a signal based on the drive signal, a high side transistor that is coupled between a high side of a power supply and the output terminal, a low side transistor that is coupled between the output terminal and a low side of the power supply, and a select unit that supplies the differential signal to a gate terminal of the high side transistor in a first case where a voltage change of the original drive signal is in an increasing and a magnitude of the voltage change exceeds the threshold, and supplies the differential signal toward a gate terminal of the low side transistor in a second case where the voltage change of the original drive signal is in a decreasing and the magnitude of the voltage change exceeds the threshold.

5. The liquid ejecting apparatus according to claim 4, wherein the select unit supplies a signal which turns off the low side transistor toward the gate terminal of the low side transistor in the first case, supplies a signal which turns off the high side transistor toward the gate terminal of the high side transistor in the second case, and supplies the signal which turns off the high side transistor toward the gate terminal of the high side transistor and supplies the signal which turns off the low side transistor to the gate terminal of the low side transistor, in case where the magnitude of the voltage change of the original drive signal is less than or equal to the threshold.

6. The liquid ejecting apparatus according to claim 5, wherein the select unit turns off both the high side transistor and the low side transistor, based on a designation signal that indicates whether or not the magnitude of the voltage change of the original drive signal is less than or equal to the threshold.

7. The liquid ejecting apparatus according to claim 6, wherein the variable resistor is a switch which is turned on or off based on the designation signal.

8. The liquid ejecting apparatus according to claim 1, wherein the ejecting unit, the amplification unit, and the voltage output unit are mounted on a movable carriage.

9. A drive circuit which drives a capacitance load based on a drive signal that is output from a predetermined output terminal, the circuit comprising:

an amplification unit that amplifies an original drive signal which is an origin of the drive signal and outputs the amplified signal toward the output terminal; and a voltage output unit that outputs a voltage responding to the original drive signal toward the output terminal during a predetermined period of a part or all of a period in which a magnitude of a voltage change of the original drive signal is less than or equal to a threshold.

* * * * *